US006296994B1

(12) United States Patent
Sowinski et al.

(10) Patent No.: US 6,296,994 B1
(45) Date of Patent: Oct. 2, 2001

(54) PHOTOGRAPHIC ELEMENTS FOR COLORIMETRICALLY ACCURATE RECORDING INTENDED FOR SCANNING

(75) Inventors: Allan F. Sowinski; Lois A. Buitano; Steven G. Link, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/259,694

(22) Filed: Mar. 1, 1999

(51) Int. Cl.[7] ..... G03C 1/005; G03C 1/08
(52) U.S. Cl. ..... 430/505; 430/506
(58) Field of Search ..... 430/505, 506

(56) References Cited

U.S. PATENT DOCUMENTS

| | | | | |
|---|---|---|---|---|
| 3,672,898 | | 6/1972 | Schwan et al. . | |
| 4,599,301 | | 7/1986 | Ohashi et al. . | |
| 5,037,728 | * | 8/1991 | Shiba et al. | 430/505 |
| 5,053,324 | | 10/1991 | Sasaki . | |
| 5,077,182 | * | 12/1991 | Sasaki et al. | 430/504 |
| 5,166,042 | | 11/1992 | Nozawa . | |
| 5,169,746 | | 12/1992 | Sasaki . | |
| 5,206,124 | | 4/1993 | Shimazaki et al. . | |
| 5,206,126 | | 4/1993 | Shimazaki et al. . | |
| 5,258,273 | | 11/1993 | Ezaki et al. . | |
| 5,308,748 | | 5/1994 | Ikegawa et al. . | |
| 5,376,508 | | 12/1994 | Yamada et al. . | |
| 5,460,928 | | 10/1995 | Kam-Ng et al. . | |
| 5,582,961 | | 12/1996 | Giogianni et al. . | |
| 5,609,978 | | 3/1997 | Giorgianni et al. . | |

FOREIGN PATENT DOCUMENTS

| | | |
|---|---|---|
| 3740340 A1 | 8/1988 | (DE) . |
| 0 409 019 | 7/1990 | (EP) . |
| 0 866 368 A2 | 9/1998 | (EP) . |

OTHER PUBLICATIONS

Abstract, EP 866368 A.

* cited by examiner

*Primary Examiner*—Janet Baxter
*Assistant Examiner*—Amanda C. Walke
(74) *Attorney, Agent, or Firm*—Edith A. Rice

(57) ABSTRACT

A color photographic element particularly useful for colorimetrically accurate recording of scene exposures is disclosed, which is capable of producing differentiable dye images suitable for scanning and electronic image processing. The element has red, green and blue light recording silver halide emulsion layer units and provides broad, hypsochromic green spectral sensitivity that overlaps with the red spectral sensitivity. The wavelength of maximum sensitivity of the red recording emulsion layer unit is between about 580 and 620 nm, the wavelength of maximum sensitivity of the green recording emulsion layer unit is between about 520 and 565 nm, the relative sensitivity of the green recording emulsion layer unit at 50% of the maximum sensitivity exhibits an overall breadth of at least about 65 nm, and the relative sensitivity of the green recording emulsion layer unit at 520 nm is at least 60% of the maximum.

11 Claims, 5 Drawing Sheets

PHOTOGRAPHIC ELEMENTS FOR COLORIMETRICALLY ACCURATE RECORDING INTENDED FOR SCANNING

CROSS REFERENCE TO RELATED APPLICATIONS

This application is related to commonly assigned copending applications U.S. Ser. Nos. 09/129,358 filed Aug. 5, 1998, 09/129,948 filed Aug. 5, 1998 and 09/925,835 filed Sep. 5, 1998. The entire disclosures of these related applications are incorporated herein by reference.

FIELD OF THE INVENTION

The field of the invention is color photographic films intended to be scanned in order to retrieve the recorded image for viewing. The element is particularly suitable for accurately capturing scene light exposures with high colorimetric precision, where image transformation to a viewable form is achieved by film scanning, electronic signal processing, and image file transfer to an output device.

DEFINITION OF TERMS

In referring to grains and emulsions containing two or more halides, the halides are named in order of ascending concentrations.

The terms "high chloride" and "high bromide" in referring to grains and emulsions indicate that chloride or bromide, respectively, is present in a concentration of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The terms "blue spectral sensitizing dye", "green spectral sensitizing dye", and "red spectral sensitizing dye" refer to a dye or combination of dyes that sensitize silver halide grains and, when adsorbed, have their peak absorption in the blue, green and red regions of the spectrum, respectively.

The term "half-peak bandwidth" in referring to a dye indicates the spectral region over which absorption exhibited by the dye is at least half its absorption at its wavelength of maximum absorption.

In referring to blue, green and red recording dye image forming layer units, the term "layer unit" indicates the layer or layers that contain radiation-sensitive silver halide grains to capture exposing radiation and that contain couplers that react upon development of the grains. The grains and couplers are usually in the same layer, but can be in adjacent layers.

The term "overall half-peak bandwidth" indicates the spectral region over which a combination of spectral sensitizing dyes within a layer unit exhibits absorption that is at least half their combined maximum absorption at any single wavelength.

The term "dye image-forming coupler" indicates a coupler that reacts with oxidized color developing agent to produce a dye image.

The term "colored masking coupler" indicates a coupler that is initially colored and that loses its initial color during development upon reaction with oxidized color developing agent.

The term "substantially free of colored masking coupler" indicates a total coating coverage of less than 0.02 millimole/$m^2$ of colored masking coupler.

The term "development inhibitor releasing compound" or "DIR" indicates a compound that cleaves to release a development inhibitor during color development. As defined DIR's include couplers and other compounds that utilize anchimeric and timed releasing mechanisms.

The term "Status M" density indicates density measurements obtained from a densitometer meeting photocell and filter specifications described in *SPSE Handbook of Photographic Science and Engineering*, W. Thomas, editor, John Wiley & Sons, New York, 1973, Section 15.4.2.6 Color Filters. The International Standard for Status M density is set out in "Photography—Density Measurements—Part 3: Spectral conditions", Ref. No. ISO 5/3-1984 (E).

The term "exposure latitude" indicates the exposure range of a characteristic curve segment over which instantaneous gamma ($\Delta D/\Delta \log E$) is at least 25 percent of gamma, as defined above. The exposure latitude of a color element having multiple color recording units is the exposure range over which the characteristic curves of the red, green, and blue color recording units simultaneously fulfill the aforesaid definition.

The term "gamma ratio" when applied to a color recording layer unit refers to the ratio determined by dividing the color gamma of a cited layer unit after an imagewise color separation exposure and process that enables development of primarily that layer unit by the color gamma of the same layer unit after an imagewise white light exposure and process that enables development of all layer units. This term relates to the degree of color saturation available from that layer unit after conventional optical printing. Larger values of the gamma ratio indicate enhanced degrees of color saturation under optical printing conditions.

*Research Disclosure* is published by Kenneth Mason Publications, Ltd., Dudley House, 12 North St., Emsworth, Hampshire P010 7DQ, England.

BACKGROUND OF THE INVENTION

Photographic recording materials have historically been designed to operate in an analog world involving direct optical print-through to a reflection print material or direct viewing of transmitted light, depending on the mode of image development. Color negative films record scene light exposures and, following development and chemical image processing through interlayer interimage effects generally produced by colored masking couplers and development inhibitor releasing couplers, yield orange masked-films suitable for the attenuation of light to allow the exposure of silver halide color paper giving a viewable representation of the scene after its processing and drying. Color reversal films record scene light exposures and, following development and chemical image processing through interlayer interimage effects generally produced by first development iodide gradients and second development inhibitor releasing couplers, yield positive images suitable for projection and viewing in a dark surround. The accuracy of recording the different colors of visible light in the scene exposures is limited by either the constituents the films were required to contain to perform their function (e.g. colored masking couplers in color negative films) or the degree of chemical image processing achievable for color correction or 'management' by chemical development modification.

With the introduction of color film scanning, however, the role of films in producing images is fundamentally changed.

The color film image dye densities of films designed exclusively for scanning are no longer required to attenuate the precise exposure of silver halide color paper or the human eye with fully color corrected dye hues. A suitable exposure of scanner charged coupled device arrays to create image-bearing electronic signals can be accomplished with image dye amounts that have not been modified by development interlayer interimage effects. The color correction that was formally performed chemically can be done with higher effectiveness by mathematical transformations of the electronic signals which are required anyway to convert the image-bearing signals back into a viewable form, such as to code values used by a computer color monitor display or by a writing device such as an inkjet printer. In relying on electronic image processing, the color films can be re-designed to record scene exposures with greater accuracy. More accurate color recording of the scene light is in fact vital to obtain the full benefit of such hybrid systems. The unique non-linear signal amplifications available to electronic image processing can produce a multitude of different high quality renditions of the scene, depending on individual preferences, but these renditions will be unfaithful in their color rendition and disappointing, if the color film failed to record the scene exposures correctly at the time of photography. Such color accuracy requirements are found in metameric color failure, where the certain objects with very different spectral reflectance properties stimulate the human visual system sensitivities the same. Since optical color film spectral sensitivities differ from that of the eye, theses films record the scene exposures differently leading to color recording errors. In certain artificial illuminants, such as inexpensive fluorescent lights, closely spaced line emissions by the tube phosphors correctly stimulate the overlapping eye RGB channels to produce the appearance of neutral white light, and nearly normal white light colors of viewed objects or subjects results. The non-overlapping spectral sensitivities of color films result in relatively large color recording gaps, and inaccurate color rendition the same objects or subjects inevitably results. Color films designed for scanning and electronic processing of the image-bearing signals can benefit from silver halide emulsion spectral sensitivity that is more calorimetrically accurate.

Examples of spectral sensitivities that better approximate the human visual response and which resemble color matching functions have been described. MacAdam (Pearson and Yule, *J Color Appearance*, 2, 30 (1973)), Schwan et al U.S. Pat. No. 3,672,898 and Giorgianni et al U.S. Pat. No. 5,609,978 and U.S. Pat. No. 5,582,961 are illustrative of attempts to improve color reproduction by intentionally selecting spectral sensitizing dye combinations for blue, green, and red recording layer units that overlap more and differ from the wavelengths of maximum relative sensitivity of usual analog optical system color films. Giorgianni et al '978 and '961 are herein incorporated by reference. Schwan et al however stipulate that the cyan dye image-forming layer contain at least one light sensitive silver halide emulsion with a maximum sensitivity greater than 603 nm. In addition, the red recording unit is comprised of a magenta colored filter dye material which absorbs visible radiation shorter than the maximum sensitivity of said cyan-dye forming unit. Adequate red recording unit hypsochromic sensitivity for optimal calorimetrically accurate capture is not provided in the presence of the magenta trimmer dye filtering the scene exposures incident on it. Giorgianni et al demonstrate color reversal films with red recording unit maximum sensitivity around 600 nm, with broad half-peak bandwidth relative sensitivity in the same red unit, and with substantially overlapping green and red recording silver halide emulsion unit spectral sensitivity. But the green recording silver halide emulsion unit 50%-maximum peak bandwidth spans only about 60 nm, and sensitivity at 520 nm in the hypsochromic, shorter green region is 53% of the maximum relative sensitivity. In addition, the blue recording silver halide unit maximum sensitivity is found at about 422 nm, contributing to reduced blue and green recording unit overlapping sensitivity. In aggregate, the colorimetric accuracy of the element was handicapped by these flaws.

PROBLEM TO BE SOLVED BY THE INVENTION

In order to achieve accurate color reproduction, the photographic element red and green sensitivity must meet certain requirements provided by dyed silver halide emulsions. The green and red maximum sensitivities must fall somewhat more hypsochromic of their usual positions in films designed for direct optical printing or viewing. The green record sensitivity must be broad, with substantial relative short green responsivity. The need for high color accuracy recording by a silver halide emulsion-based image capture element that provides the colorimetry of scene exposures remains unsatisfied.

SUMMARY OF THE INVENTION

The present invention can be viewed as an improvement on teachings of Buitano et al in that it has been discovered that improved color capture accuracy can be achieved when the green unit spectral relative spectral sensitivity at 520 nm is at least 60% of the maximum sensitivity.

In one aspect this invention is directed to a color photographic element capable of producing dye images suitable for digital scanning comprised of:

a support and, coated on the support, a plurality of hydrophilic colloid layers including a blue recording emulsion layer unit capable of forming a dye image of a first hue, a green recording emulsion layer unit capable of forming a dye image of a second hue, and a red recording emulsion layer unit capable of forming a dye image of a third hue, wherein, the wavelength of maximum sensitivity of the red recording emulsion layer unit is between about 580 and 620 nm, the wavelength of maximum sensitivity of the green recording emulsion layer unit is between about 520 and 565 nm, the relative sensitivity of the green recording emulsion layer unit at 50% of the maximum sensitivity exhibits an overall breadth of at least about 65 nm, the relative sensitivity of the green recording emulsion layer unit at 520 nm is at least 60% of the maximum, with the proviso that magenta colored filter materials are absent from the red recording emulsion layer unit.

ADVANTAGEOUS EFFECT OF THE INVENTION

When photographic recording materials according to the invention are prepared, shorter red spectral sensitivity, with maximum response of between about 580 and 620 nm, and broad green spectral sensitivity, at a maximum sensitivity between about 520 and 560 nm, is produced with significant relative sensitivity at wavelengths between about 500 and 575 nm and specifically at shorter green light wavelengths around 520 nm. In preferred embodiments of the invention, the broad green sensitivity is produced in conjunction with a broad red spectral sensitivity which provides for significant overlap of the green and red responsivities at a significant fraction of the maximum relative sensitivity, in analogy with the human visual response. Elements in accord with the invention can achieve low color recording errors by accurately capturing scene light exposures which provides the opportunity for improved hybrid photographic-electronic imaging system color reproduction fidelity.

DETAILED DESCRIPTION OF THE INVENTION

Figure 1:
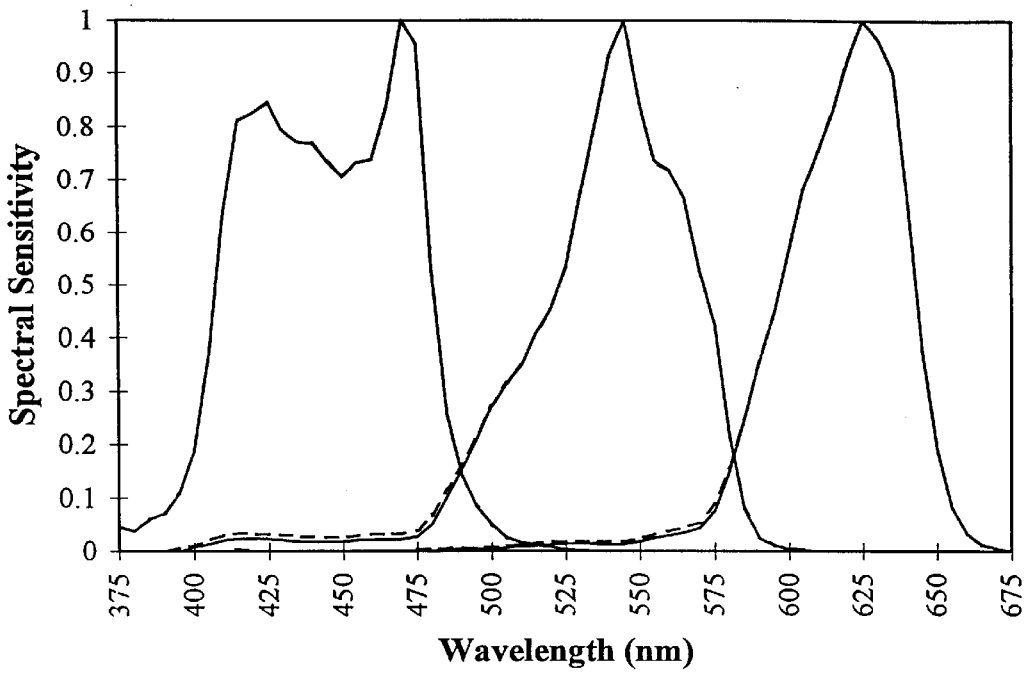
FIG. 1 compares color photographic recording material relative spectral sensitivity responses derived from Status M densities (dash line) and analytical densities (solid line) for comparative control Sample 102 below of the conventional color negative film art.

A typical color negative film construction useful in the practice of the invention is illustrated by the following:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. The element can contain additional layers, such as filter layers, interlayers, overcoat layers, subbing layers, antihalation layers and the like. Transparent and reflective support constructions, including subbing layers to enhance adhesion, are disclosed in *Research Disclosure*, Item 38957, cited above, XV. Supports. Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m. It is preferred that the total layer thickness be less than 28 $\mu$m, more preferred that the total layer thickness be less than 22 $\mu$m, and most preferred that the total layer thickness be less than 17 $\mu$m. This constraint on total layer thickness is enabled by controlling the total quantity light sensitive silver halide as described below, and by controlling the total quantity of vehicle and other components, such as couplers, solvent, and such in the layers. The total quantity of vehicle is generally less than 20 g/m$^2$, preferably less than 14 g/m$^2$, and more preferably less than 10 g/m$^2$. Generally, at least 3 g/m$^2$ of vehicle, and preferably at least 5 g/m$^2$ of vehicle is present so as to ensure adhesion of the layers to the support during processing and proper isolation of the layer components. Likewise, the total quantity of other components is generally less than 12 g/m$^2$, preferably less than 8 g/m$^2$, and more preferably less than 5 g/m$^2$.

The emulsion in BU is capable of forming a latent image when exposed to blue light. When the emulsion contains high bromide silver halide grains and particularly when minor (0.5 to 20, preferably 1 to 10, mole percent, based on silver) amounts of iodide are also present in the radiation-sensitive grains, the native sensitivity of the grains can be relied upon for absorption of blue light. Preferably the emulsion is spectrally sensitized with two or more blue spectral sensitizing dyes to achieve the required absorption breadth of color matching function spectral sensitivity which mimics human visual sensitivity. Tabular emulsions are preferred for providing dyed blue spectral sensitivity. The emulsions in GU and RU are spectrally sensitized with green and red spectral sensitizing dyes, respectively, in all instances, since silver halide emulsions have no native sensitivity to green and/or red (minus blue) light. The red unit emulsions of the invention preferably are comprised of at least four spectral sensitizing dyes. More preferably, at least five spectral sensitizing dyes are employed to achieve the required spectral breadth of responsivity to green-red light.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically preferred for the blue sensitive recording unit. The green sensitive recording unit is preferably comprised of tabular grains with an aspect ratio of less than or equal to 15. The grains preferably form surface latent images so that they produce negative images when processed in a surface developer in color negative film forms of the invention.

Illustrations of conventional radiation-sensitive silver halide emulsions are provided by *Research Disclosure*, Item 38957, cited above, I. Emulsion grains and their preparation. Chemical sensitization of the emulsions, which can take any conventional form, is illustrated in section IV. Chemical sensitization. Spectral sensitization and sensitizing dyes, which can take any conventional form, are illustrated by section V. Spectral sensitization and desensitization. The emulsion layers also typically include one or more antifoggants or stabilizers, which can take any conventional form, as illustrated by section VII. Antifoggants and stabilizers.

While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 2 g of coated silver per m$^2$ of support surface area in the element is necessary to realize an exposure latitude of at least 2.7 log E while maintaining an adequately low graininess position for pictures intended to be enlarged. The green light recording layer unit is preferred to have a coated silver coverage of at least 0.8 g/m$^2$. It is more preferred that the red and green units together have at least 1.7 g/m$^2$ of coated silver and even more preferred that each of the red, green, and blue color units has at least 0.8 g/m$^2$ of coated silver. Because of its less favored location for processing, it is generally preferred that the layer unit located, on average, closest to the support contain a silver coating coverage of at least 1.0 g/m$^2$ of coated silver. Typically, this is the red recording layer unit. For many photographic applications, optimum silver coverages are at least 0.9 g/m$^2$ in the blue recording layer unit and at least 1.5 g/m$^2$ in the green and red recording layer units.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure*, Item 38957, cited above, X. Dye image formers and modifiers, B. Image-dye-forming couplers. Magenta colored masking couplers are absent from RU.

The invention is applicable to conventional color negative film or color reversal film constructions. The spectral sensitivities can also be employed in photothermographic elements, and in particular, camera speed photothermographic elements as known in the art. Specific examples of multicolor photothermographic elements are described by Levy et al. In U.S. patent application Ser. No. 08/740,110, filed Oct. 28, 1996, by Ishikawa et al in European Patent Application EP 0, 762,201 A1, and by Asami in U.S. Pat. No. 5,573,560, the disclosures of which are both incorporated by reference. The invention is also applicable to image transfer photothermographic elements such as disclosed in Ishikawa et al European Patent Application EP 0 800 114 A2. In a preferred embodiment, contrary to conventional color negative film constructions, RU, GU and BU are each substantially free of colored masking coupler. Preferably the layer units each contain less than 0.02 (most preferably less than 0.01) millimole/m$^2$ of colored masking coupler. No colored masking coupler is required in the color negative elements of this invention.

Development inhibitor releasing compound is incorporated in at least one and, preferably, each of the layer units in color negative film forms of the invention. DIR's are commonly employed to improve image sharpness and to tailor dye image characteristic curve shapes. The DIR's contemplated for incorporation in the color negative elements of the invention can release development inhibitor moieties directly or through intermediate linking or timing groups. The DIR's are contemplated to include those that employ anchimeric releasing mechanisms. Illustrations of development inhibitor releasing couplers and other compounds useful in the color negative elements of this invention are provided by *Research Disclosure*, Item 38957, cited above, X. Dye image formers and modifiers, C. Image dye modifiers, particularly paragraphs (4) to (11).

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure*, Item 38957, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure*, Item 38957, VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure*, Item 38957, VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure*, Item 38957, IX. Coating physical property modifying addenda. The SOC overlying the emulsion layers additionally preferably contains an ultraviolet absorber, such as illustrated by *Research Disclosure*, Item 38957, VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta \log E$) by doubling changes in density ($\Delta D$). Thus, gamma's as low as 1.0 or even 0.6 are contemplated and exposure latitudes of up to about 5.0 log E or higher are feasible. Gammas of about 0.55 are preferred. Gammas of between about 0.4 and 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure*, Item 38957, X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in Polaroid ? dye image transfer systems. These and other image transfer systems compatible with the practice of the invention are disclosed in *Research Disclosure*, Vol. 176, December 1978, Item 17643, XXIII. Image transfer systems.

One of the advantages of incorporating a color negative element in an image transfer system is that processing solution handling during photographic processing is not required. A common practice is to encapsulate a developer in a pod. When the image transfer unit containing the pod is passed between pressure rollers, developing agent is released from the pod and distributed over the uppermost processing solution permeable layer of the film, followed by diffusion into the recording layer units.

Similar release of developer is possible in color negative elements according to the invention intended to form only a retained dye image. Prompt scanning at a selected stage of development can obviate the need for subsequent processing. For example, it is specifically contemplated to scan the film as it passes a fixed point after passing between a set of pressure (optionally heated) rollers to distribute developing agent for contact with the recording layer units. If silver coating coverages are low, as is feasible with low maximum density images and, particularly, dye image amplification systems [illustrated by Research Disclosure, Item 38957, XVIII. Chemical development systems, B. Color-specific processing systems, paragraphs (5) through (7)], the neutral density of developed silver need not pose a significant impediment to the scanning retrieval of dye image information.

It is possible to minimize or even eliminate reliance on bringing a processing agent into contact with the recording layer units for achieving development by relying on heat to accelerate or initiate processing. Color negative elements according to the invention contemplated for processing by heat can be elements, such as those containing i) an oxidation-reduction image-forming combination, such as described by Sheppard et al U.S. Pat. No. 1,976,302, Sorensen et al U.S. Pat. No. 3,152,904, Morgan et al U.S. Pat. No. 3,846,136; ii) at least one silver halide developing agent and an alkaline material and/or alkali release material, as described in Stewart et al U.S. Pat. No. 3,312,550, Yutzy et al U.S. Pat. No. 3,392,020; or iii) a stabilizer or stabilizer precursor, as described in Humphlett et al U.S. Pat. No. 3,301,678, Haist et al U.S. Pat. No. 3,531,285 and Costa et al U.S. Pat. No. 3,874,946. These and other silver halide photothermographic imaging systems that are compatible with the practice of this invention are also described in greater detail in Research Disclosure, Vol. 170, June 1978, Item 17029. More recent illustrations of silver halide photothermographic imaging systems that are compatible with this invention are illustrated by Levy et al UK 2,318,645, published Apr. 29, 1998, and Japanese Kokai (published application) 98/0133325, published May 22, 1998, and Ishikawa et al EPO 0 800 114 A2, published Oct. 8, 1997.

A number of modifications of color negative elements have been suggested for accommodating scanning, as illustrated by *Research Disclosure*, Item 38957, XIV. Scan facilitating features. These systems to the extent compatible with the color negative element constructions described above are contemplated for use in the practice of this invention. The retained silver and reflective (including fluorescent) interlayer constructions of paragraph (1) are not preferred. The features of paragraphs (2) and (3) are generally compatible with the preferred forms of the invention.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of say a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Figure 2:
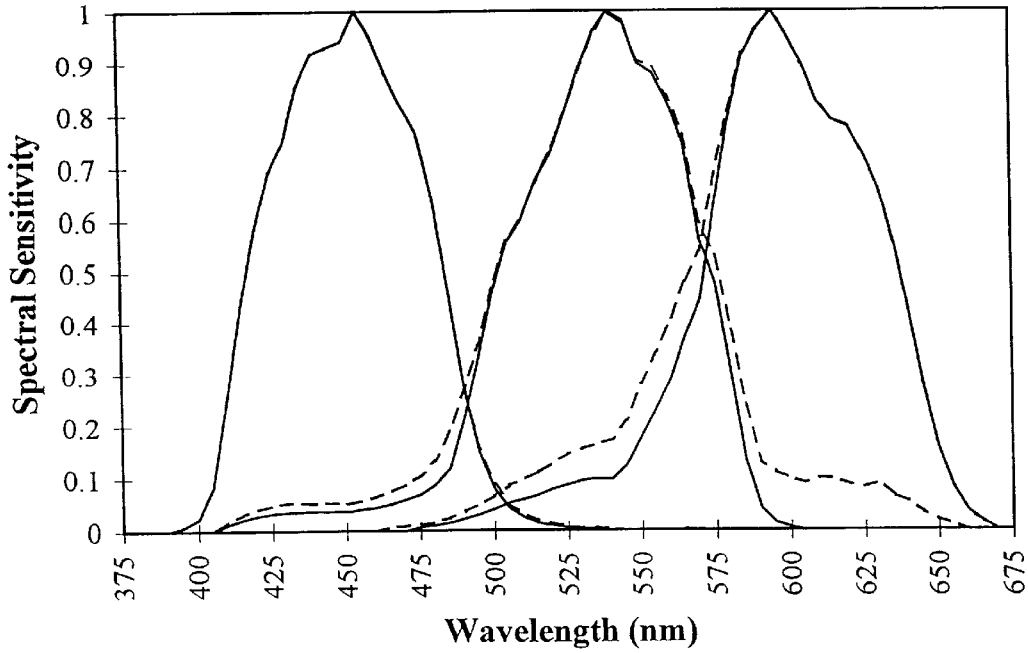
FIG. 2 compares color photographic recording material relative spectral sensitivity responses derived from Status M densities (dash line) and analytical densities (solid line) for inventive color negative film Sample 101 below.
Figure 3:
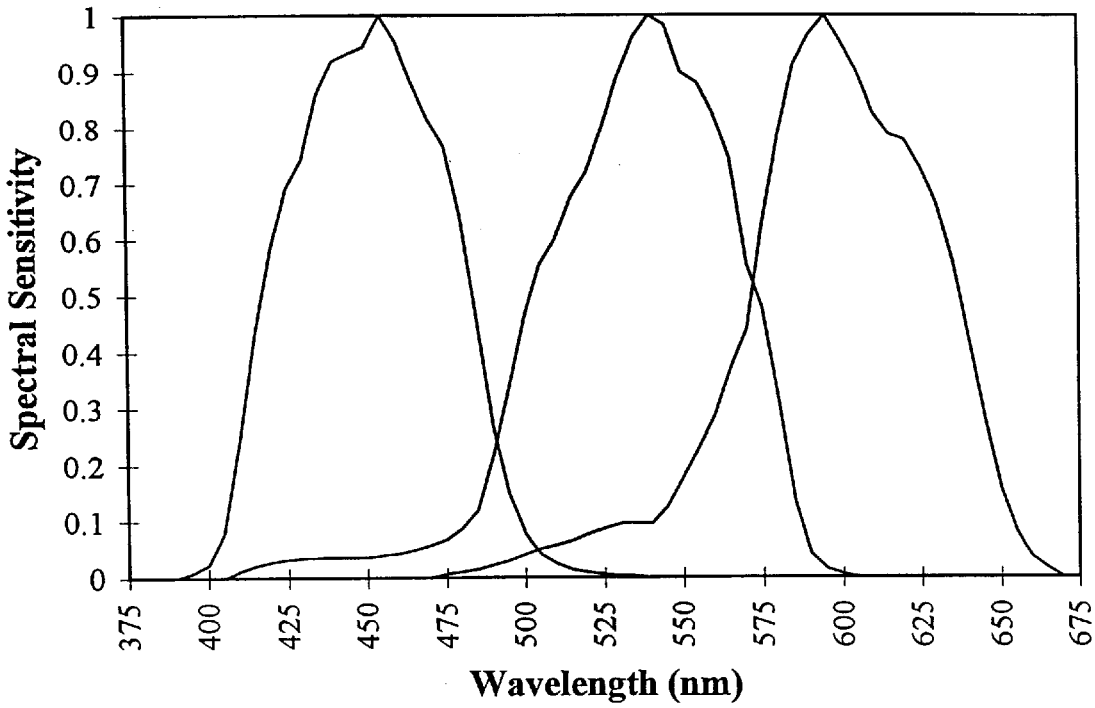
FIG. 3 shows color photographic recording material relative spectral sensitivity responses for color negative film Sample 101 below which are one preferred set of spectral sensitivities according to the present invention.
Figure 4:
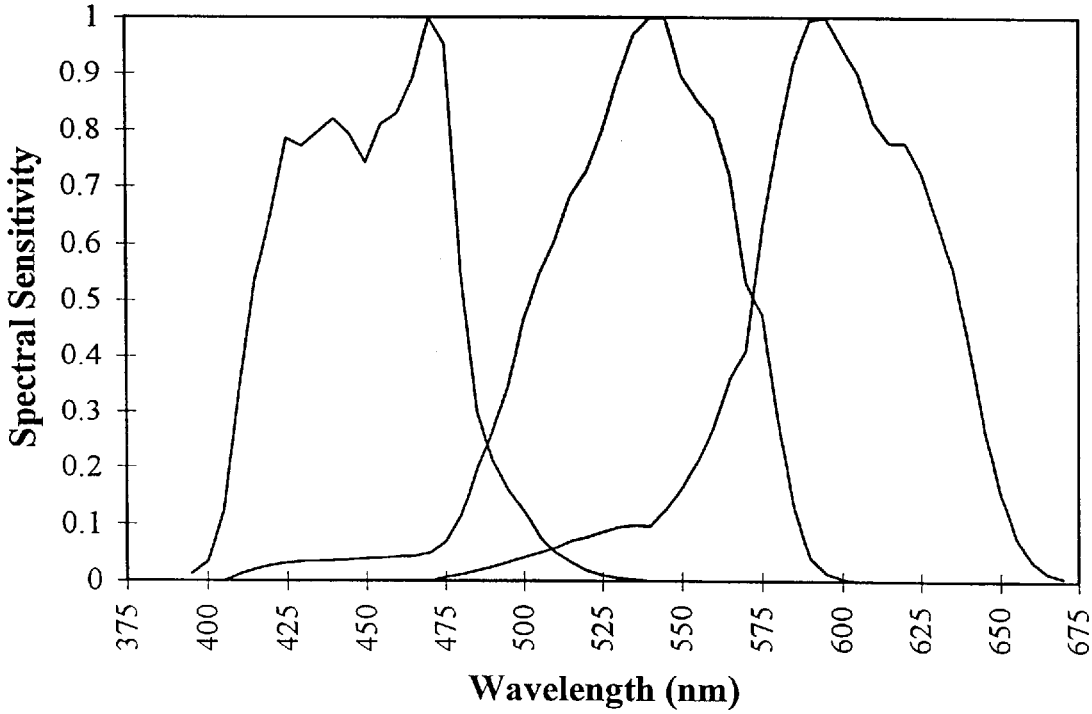
FIG. 4 shows color photographic recording material relative spectral sensitivity responses for color negative film Sample 103 below which are a second preferred set of spectral sensitivities according to the present invention.
Figure 5:
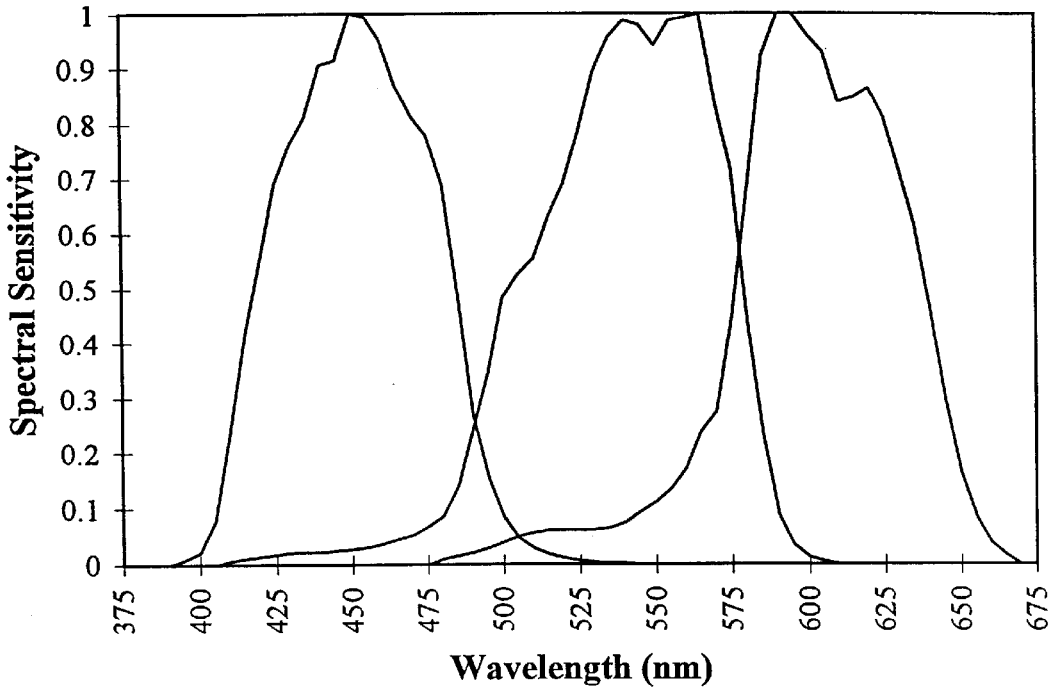
FIG. 5 shows color photographic recording material relative spectral sensitivity responses for inventive color negative film Sample 104 below, which are a third preferred set of spectral sensitivities according to the present invention.
Figure 6:
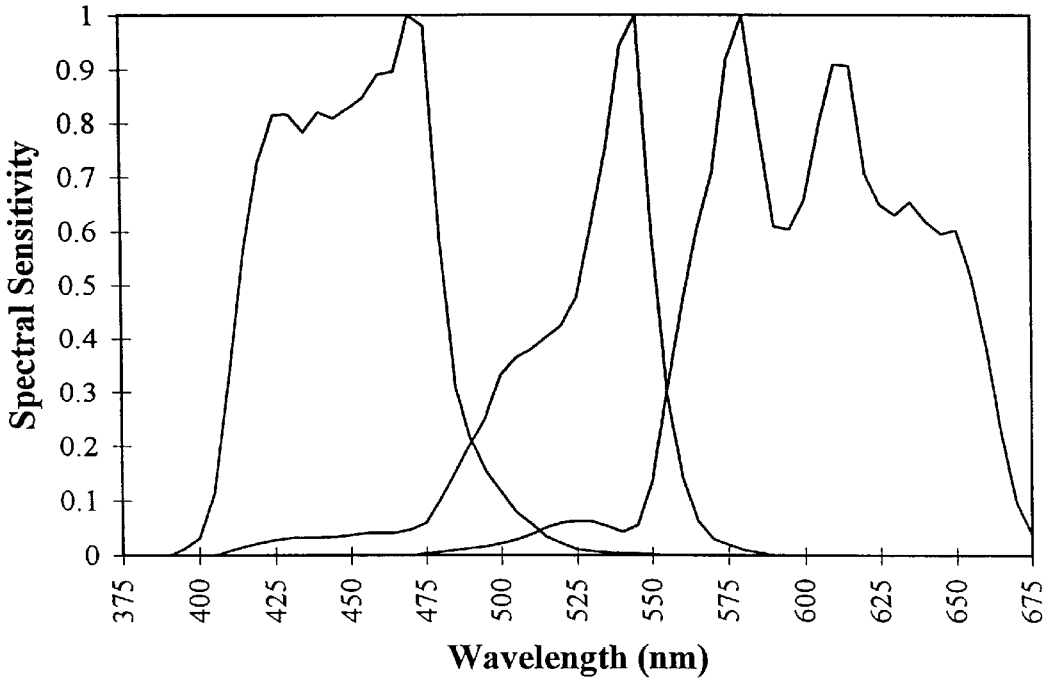
FIG. 6 shows color photographic recording material relative spectral sensitivity responses for comparative control color negative film Sample 105 below which are a representative set of color matching function spectral sensitivities of the prior art.
Figure 7:
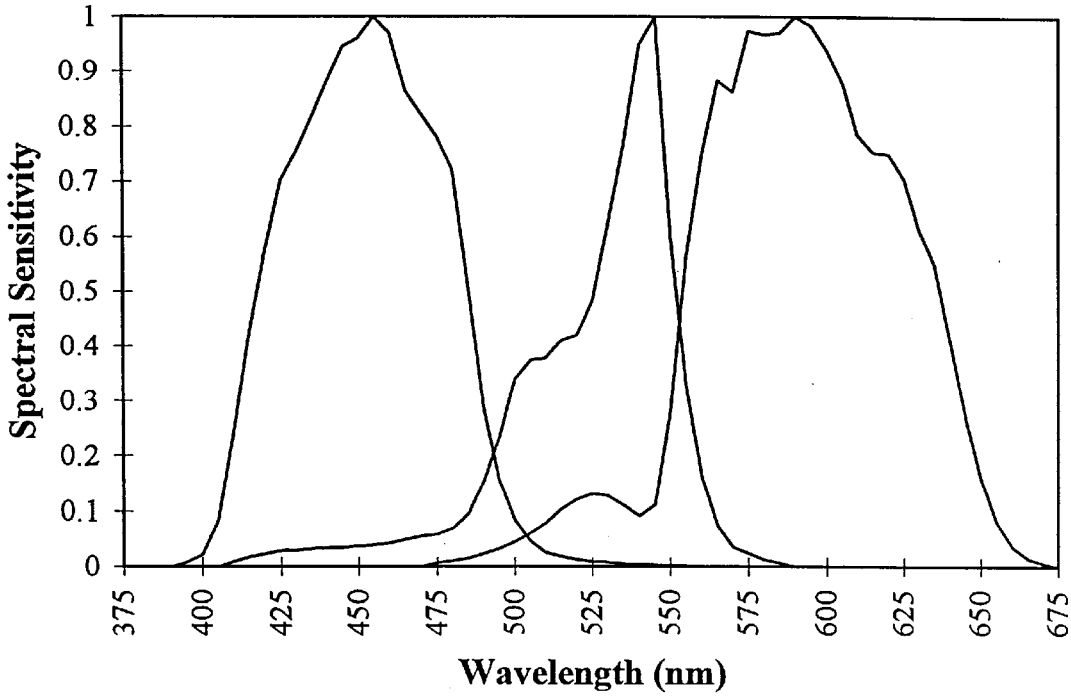
FIG. 7 shows color photographic recording material relative spectral sensitivity responses for comparative control color negative film Sample 106 below.
Figure 8:
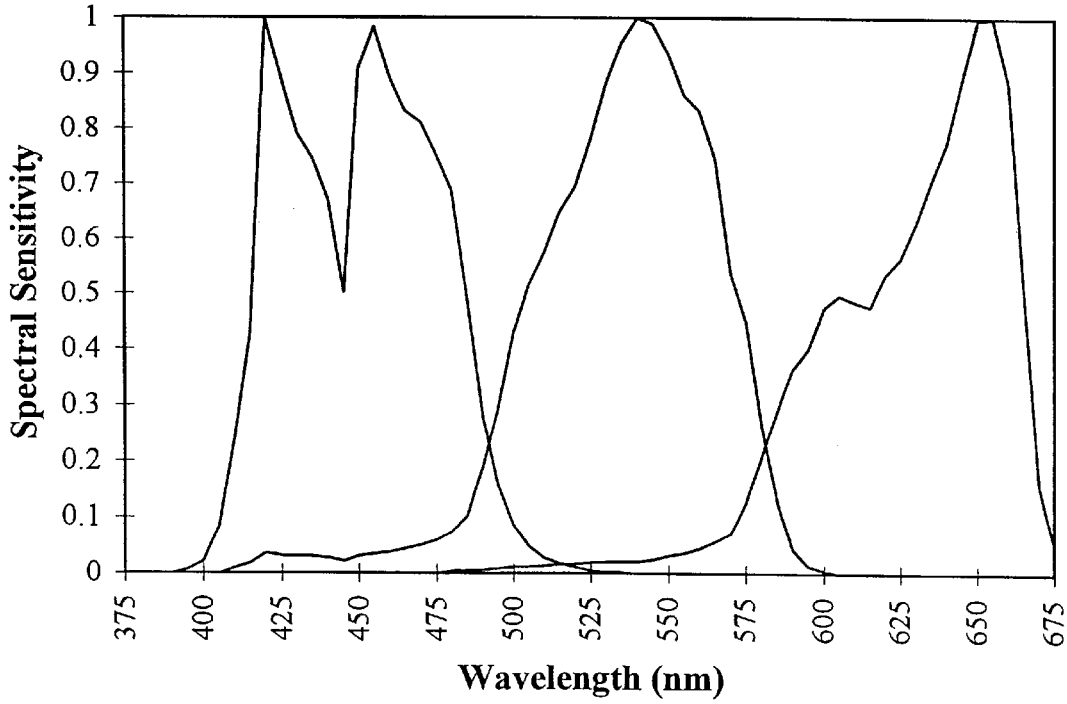
FIG. 8 shows color photographic recording material relative spectral sensitivity responses for comparative control color negative film Sample 107 below.
Figure 9:
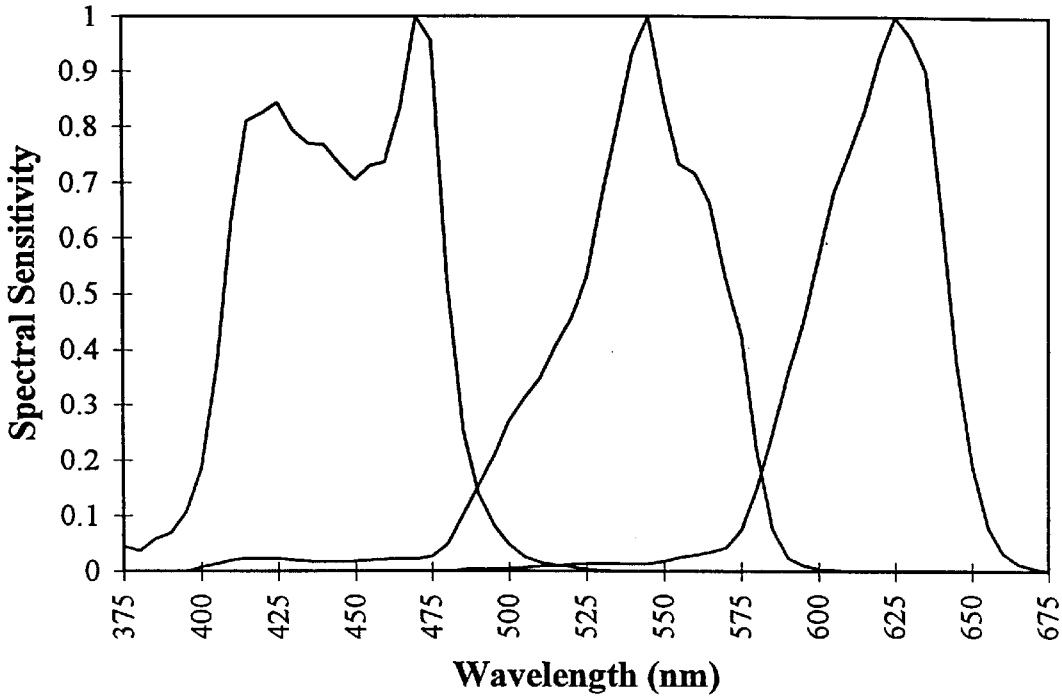
FIG. 9 shows color photographic recording material relative spectral sensitivity responses for comparative control color negative film Sample 102 below.

FIG. 1 compares the integral and analytical spectral sensitivity derived by the use of either form of densitometry in the course of the measurement of the speed points of image dye records formed from each of the red, green and blue sensitive units for a conventional color negative film intended for optical printing. The two forms densitometry give equivalent results. With elements of the invention, the degree of overlaps of sensitivity of the red, green and blue recording emulsion units apparently can lead to problems in accurately portraying the unit responsivity from integral densitometry. FIG. 2 shows that with a preferred embodiment of the invention, the off-peak absorptions of the same imperfect image dyes used in Sample 101 lead to increased off-peak color recording unit response when measured with integral densitometry, which vanishes when analytical densitometry is calculated to determine spectral response. It is preferred to calculate the spectral response of the color photographic elements of the invention using analytical densities. With alternate conventional cyan, magenta, and yellow image dyes showing reduced off-peak absorptance, or by the judicious selection of speed points that require larger unit responses that dominate the off-peak contributions, integral densities may be safely used to determine the color recording unit responsivity.

When radically different selections of image dyes are employed, however, the use of Status M or Status A filter sets may have no distinct meaning. For example, if three differentiable infrared image dye-forming couplers with used with the red, green, and blue color recording units, then Status M densitometry of the imagewise exposed and developed photographic film may not reveal the formation of any dye images and incorrectly indicate no visible spectral response by the element. With such radical departures in image dye selections, then analytical densities, or reference printing densities or channel independent image-bearing electronic signals derived from scanning can be used to accurately gauge the spectral response of the photographic element.

The wavelength of maximum sensitivity of the red recording emulsion layer unit falls between about 580 and 620 nm. In preferred embodiments, the red maximum sensitivity falls between about 580 and 610 nm. In more preferred forms the maximum sensitivity falls between about 580 and 605 nm and in most preferred forms, the red maximum sensitivity is below 600 nm. The wavelength of maximum sensitivity of the green recording emulsion layer unit falls between about 520 and 565 nm. In preferred embodiments, the green maximum sensitivity falls between about 520 and 550 nm. Increased green recording unit bandwidth and short green sensitivity are essential features of the invention. Thus the normalized or relative sensitivity of the green recording unit at 50% of the maximum sensitivity spans at least 65 nm. More preferably, this half peak bandwidth extends over at least 70 nm. The improved color accuracy of elements of the invention is attributable to high hypsochromic or short green sensitivity. The relative sensitivity of the green recording unit at 520 nm at least 60% of the maximum sensitivity exhibited by the unit, and more preferably it is at least 70%.

In preferred forms of the invention, broad red sensitivity and hypsochromic or short red maximum red recording emulsion unit spectral response accompany the green spectral responsivities described above. Red recording emulsion layer unit relative response at 560 nm exceeds 10% of the maximum unit sensitivity, and more preferably it exceeds about 20%. Such high hypsochromic red recording unit sensitivity and high breadth of red response bridges the region of the spectrum between green and red and produces substantial overlap in the responses of the green and red emulsion layer units. In preferred forms of the invention, the relative sensitivities of the red and green recording layer units overlap between about 550 and 600 nm. More preferably, overlap occurs over the region spanning about 565 to 590 nm. The overlap should exceed at least about 35% of the maximum relative sensitivity of the normalized red and green recording layer units spectral response. In more preferred embodiments, the point of overlap where the spectral sensitivities are equal exceeds at least 45% of the maximum relative sensitivity. Overlap points exceeding 55% are contemplated to minimize metameric color capture failure completely.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Additionally, the color purity of the layer units should be maintained. Practically, this is achieved when the gamma ratios of the red, green, and blue color units are each greater than 0.80, preferably greater than 0.85, more preferably greater than 0.90, and most preferably greater than 0.95 so as to provide for adequate color separation during the overall image forming process. The minimum gamma ratio can be adjusted by selection of image couplers to be employed such that the unwanted absorptions of the dyes formed from such couplers during a development process are minimized. Many of the dye forming couplers originally employed in color photography are incapable of achieving this level of gamma ratio since their dye absorptances are excessively broad. Likewise, selection of the specific color developing agent can be a factor in adjusting the minimum gamma ratio. Non-imagewise formation of dyes during the development process should also be limited or eliminated as, for example, by inclusion of interlayers having adequate quantities of oxidized developer scavengers and by the minimization of solution physical development. Further, adequate removal of non-imagewise densities as from retained silver or dyes from the element during processing enhances the color purity of the layer units.

The gamma ratios described are realized by limiting or excluding colored masking couplers from the elements of the invention intended for color negative development. They are also realized by proper selection of DIR compounds. It is recognized that the gamma ratios may also be attained in other ways. In one concrete example, judicious choice and balancing of light sensitive emulsion halide content, may be employed to minimize the gamma ratio by minimizing the interaction of individual color records during development. Emulsion iodide content may be particularly critical in this role. Selection of the quantity of emulsion to be employed in each light sensitive layer and the sensitization conditions employed may also be critical. Further, the use of so-called barrier layers which retard the flow of development inhibitors or of development by-products, such as halide ion, between layers so as to chemically isolate individual color recording units during development may also enable one to achieve this condition. In another concrete example, fine grained non-light sensitive silver halide or silver particles may be employed to isolate color recording layers. In yet another concrete example, polymer containing layers, including those described by Pearce et al in U.S. Pat. No. 5,254,441, the disclosures of which are incorporated by reference, may also be employed to isolate color recording layers. In a further concrete example, couplers and addenda which decrease chemical interactions between color layers may be advantageously employed. These materials include the ballasted mercaptotetrazole and derivative releasing couplers such as are described by Singer et al in U.S. patent application Ser. No. 09/015,197 filed Jan. 29, 1998, the disclosure of which is incorporated by reference.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

EXAMPLES

The invention can be better appreciated by reference to the following specific embodiments. All coating coverages are reported in parentheses in terms of g/m2, except as otherwise indicated. Silver halide coating coverages are reported in terms of silver.

PLURAL EMULSION LAYER BLUE, GREEN, AND RED RECORDING LAYER UNIT ELEMENTS

Component Properties

Glossary of Acronyms

| | |
|---|---|
| HBS-1 | Tritolyl phosphate |
| HBS-2 | Di-n-butyl phthalate |
| HBS-3 | N-n-Butyl acetanilide |
| HBS-4 | Tris(2-ethylhexyl) phosphate |
| HBS-5 | Di-n-butyl sebacate |
| HBS-6 | N,N-Diethyl lauramide |
| HBS-7 | 1,4-Cyclohexylenedimethylene bis(2-ethylhexanoate) |
| H-1 | Bis(vinylsulfonyl) methane |

ST-1

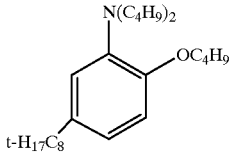

C-1

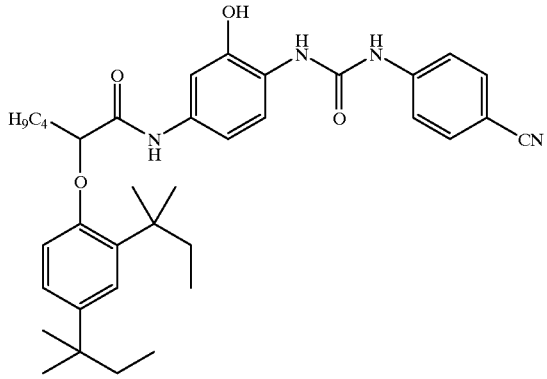

C-2

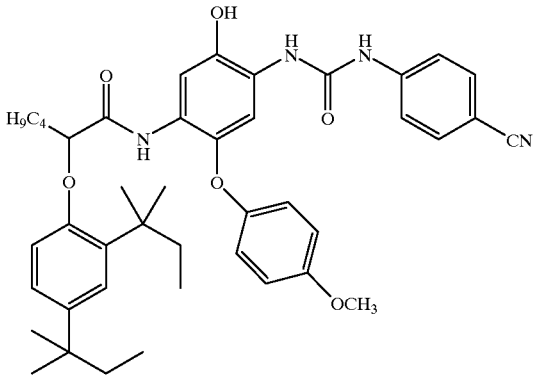

M-1

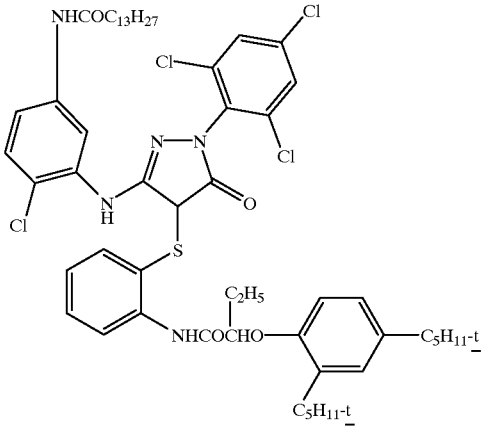

Y-1

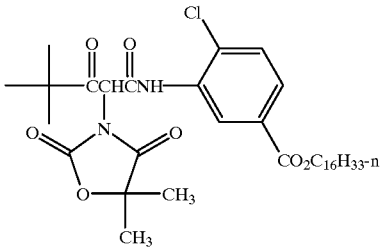

D-1

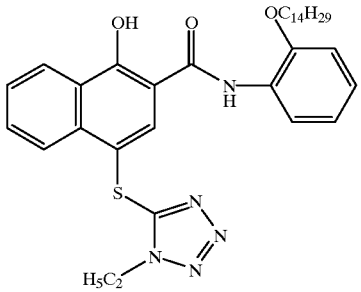

-continued
D-2
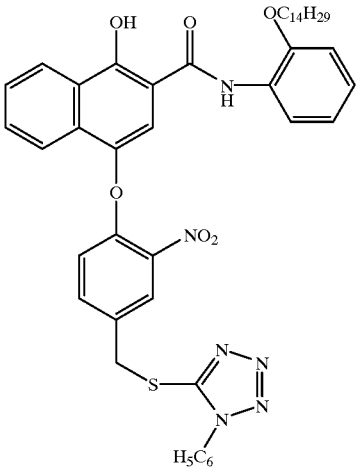
D-3
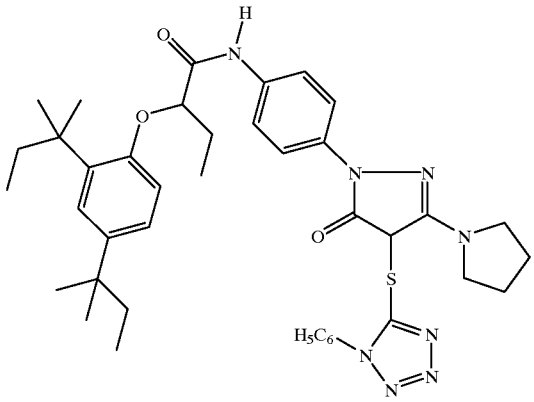
D-4
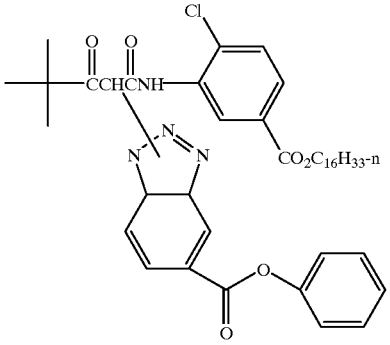
D-5
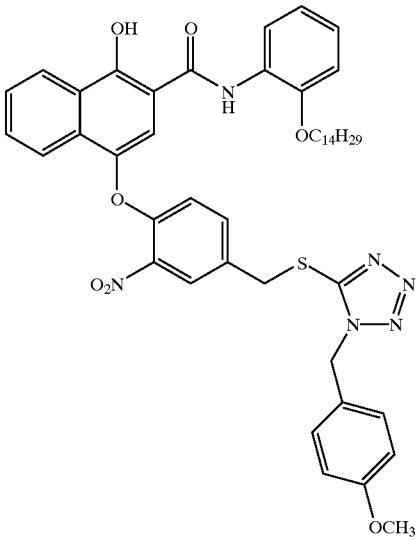
D-6
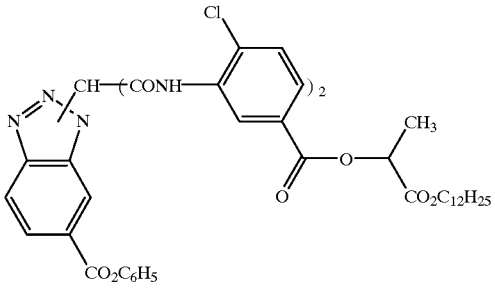
D-7
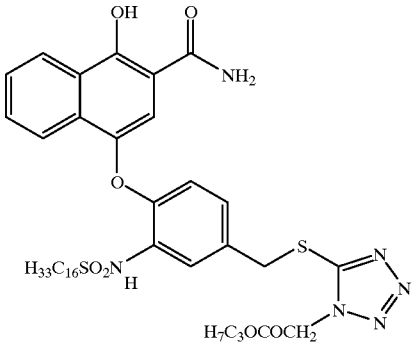

-continued
CM-1
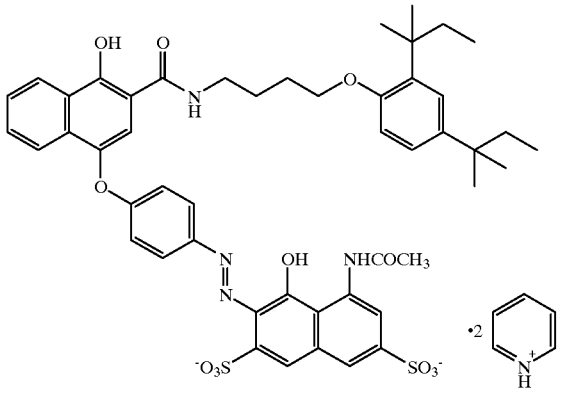
MM-1
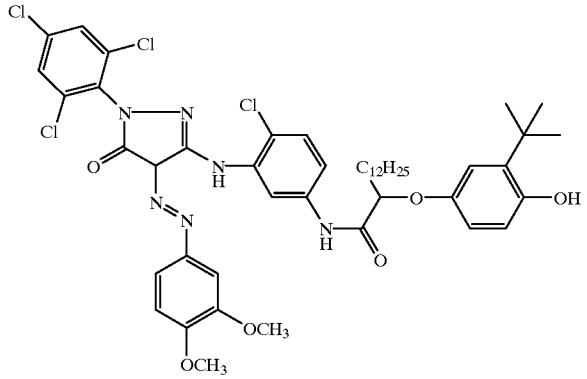
MM-2
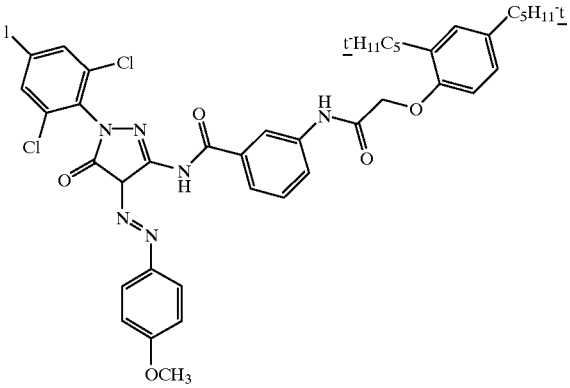
MD-1
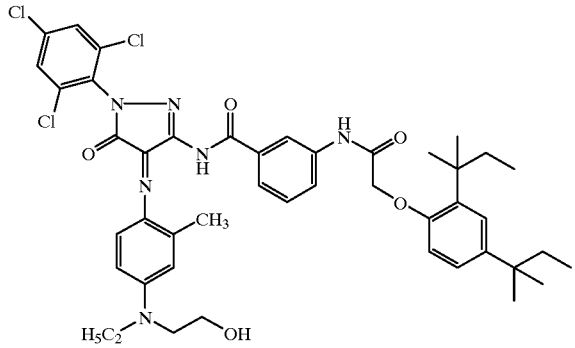
CD-1
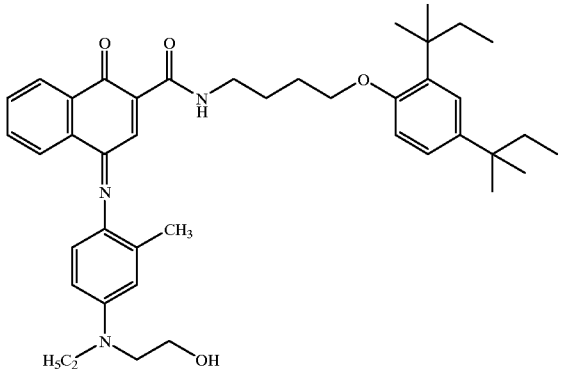
B-1
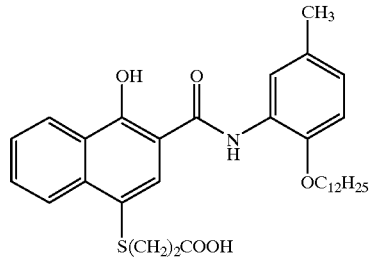
YD-1
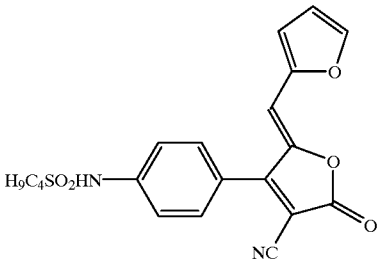
UV-1
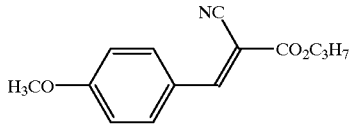

-continued
UV-2
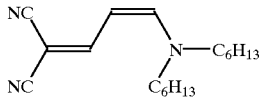
S-1
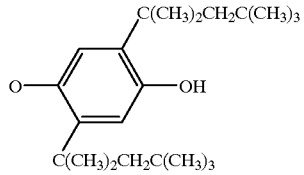
S-2
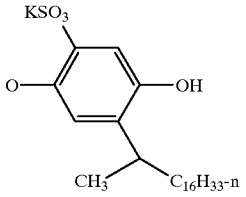
S-3
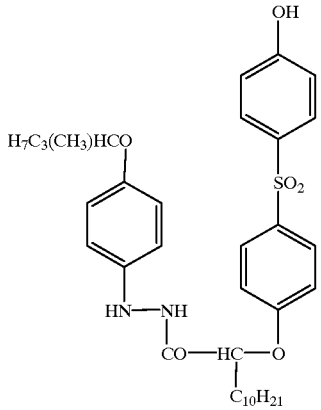
SD-1
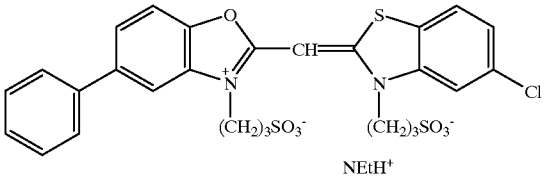
SD-2
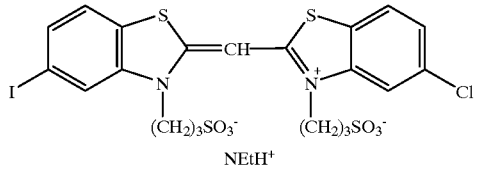
SD-3
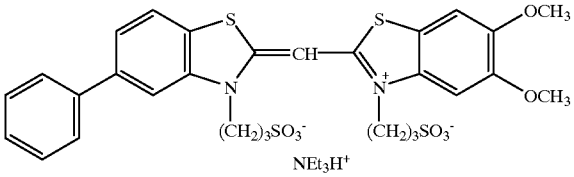
SD-4
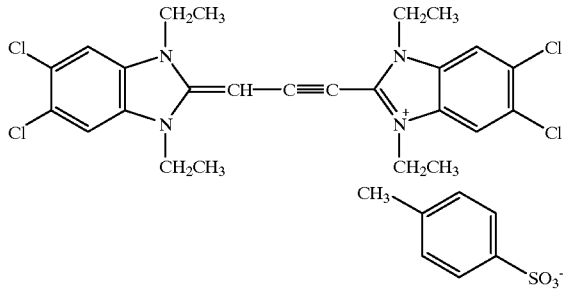
SD-5
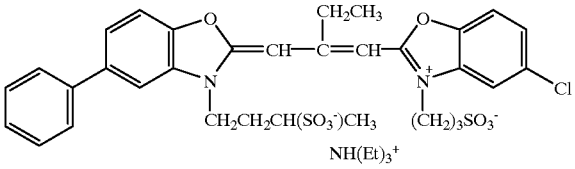
SD-6
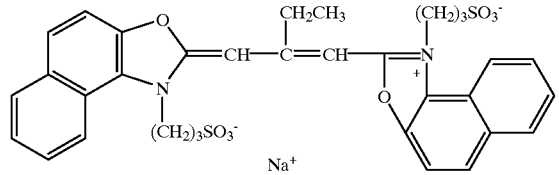
SD-7
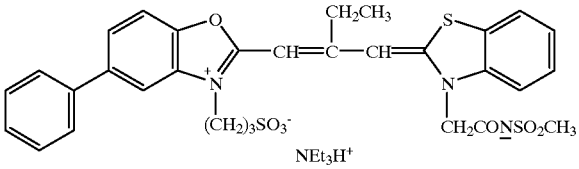
SD-8
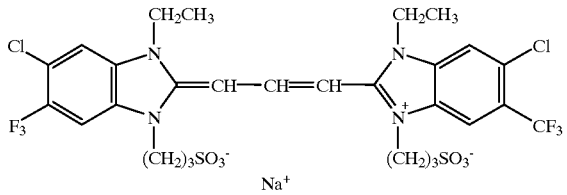

-continued

SD-9

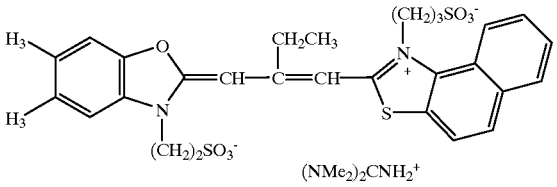

SD-10

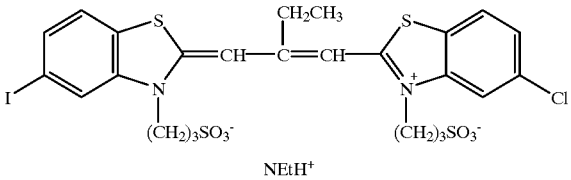

SD-11

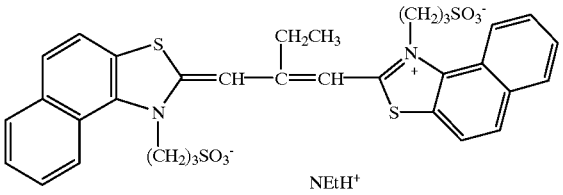

SD-12

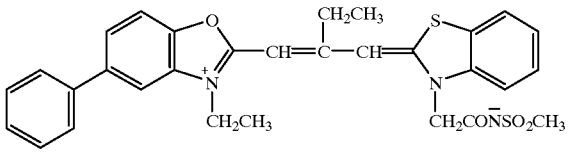

SD-13

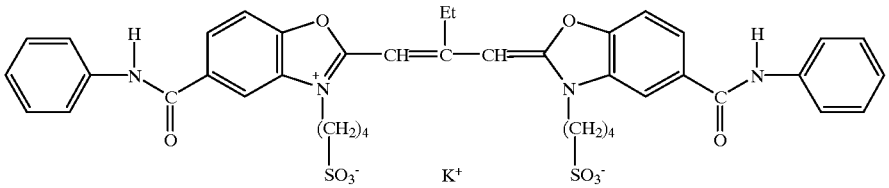

SD-14

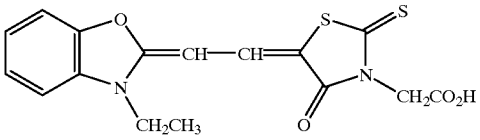

SD-15

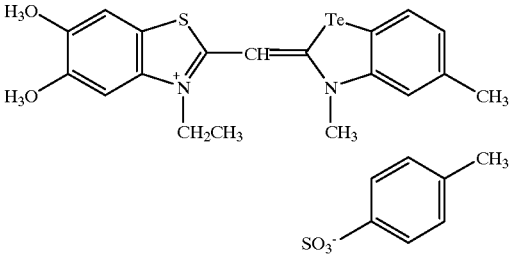

SD-16

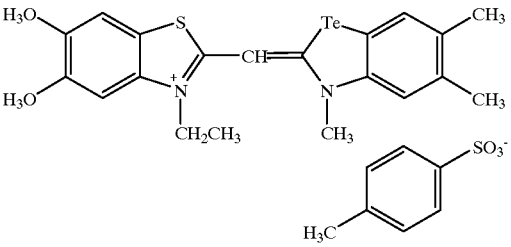

SD-17

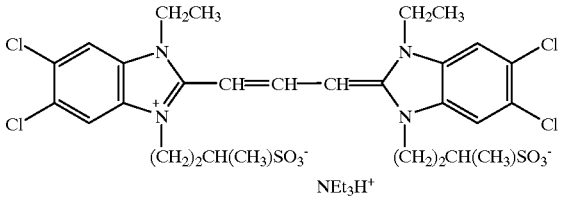

SD-18

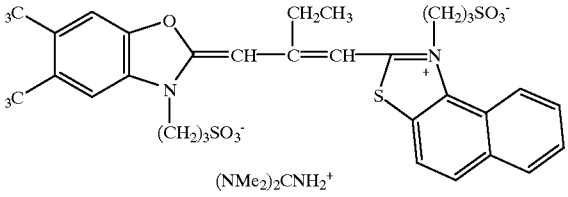

SD-19

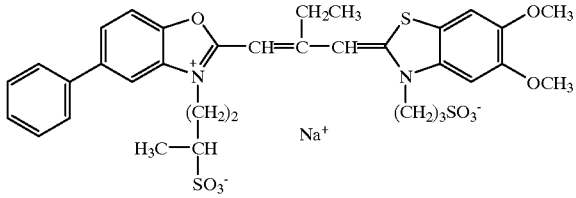

EXAMPLES

Color Negative Subdivided Unit Element Properties

Red Light Sensitive Emulsions

Silver iodobromide tabular grain emulsions EC-01, EC-02, EC-03, EC-04, and EC-05 were provided having the significant grain characteristics set out in Table 1-1 below. Tabular grains accounted for greater than 70 percent of total grain projected area in all instances. Each of Emulsions EC-01 through EC-05 were optimally sulfur and gold sensitized. In addition, these emulsions were optimally spectrally sensitized with SD-08, SD-07, SD-09, SD-10, and SD-11 in a 40:31:18:7:4 molar ratio. The wavelength of peak light absorption for all emulsions was around 570 nm, and the half-peak absorption bandwidth was around 100 nm.

TABLE 1-1

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EC-01 | 2.20 | 0.12 | 18.3 | 3.9 |
| EC-02 | 1.30 | 0.10 | 13.0 | 3.7 |
| EC-03 | 0.90 | 0.12 | 7.5 | 3.7 |
| EC-04 | 0.52 | 0.12 | 4.3 | 3.7 |
| EC-05 | 0.57 | 0.07 | 8.1 | 1.3 |

Green Light-sensitive Emulsions

Silver iodobromide tabular grain emulsions EM-01, EM-02, EM-03, and EM-04 were provided having the significant grain characteristics set out in 1-2 below. Tabular grains accounted for greater than 70 percent of total grain projected area in all instances. Each of Emulsions EM-01 through EM-04 were optimally sulfur and gold sensitized. In addition, emulsions EM-01 and EM-02 were optimally spectrally sensitized with SD-04, SD-05, SD-06, and SD-07 in a 39.4:39.4:13.4:7.8 molar ratio. Emulsions EM-03 and EM-04 were optimally spectrally sensitized with SD-04, SD-05, SD-06, and SD-07 in a 32.5:32.5:20:15 molar ratio. The wavelength of peak light absorption for all emulsions was around 540 nm, and the half-peak absorption bandwidth was around 75 nm. Substantial absorption was provided at 520, 550, and 560 nm.

TABLE 1-2

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EM-01 | 1.50 | 0.29 | 5.2 | 3.6 |
| EM-02 | 1.60 | 0.24 | 6.7 | 3.6 |
| EM-03 | 0.90 | 0.12 | 7.5 | 3.7 |
| EM-04 | 0.57 | 0.07 | 8.1 | 1.3 |

Blue Light Sensitive Emulsions

Silver iodobromide tabular grain emulsions EY-01, EY-02, EY-03, EY-04, and EY-05 were provided having the significant grain characteristics set out in Table 1-3 below. Tabular grains accounted for greater than 70 percent of total grain projected area in all instances. Each of Emulsions EY-01 through EY-05 were optimally sulfur and gold sensitized. In addition, these emulsions were optimally spectrally sensitized with SD-01, SD-02, and SD-03 in a 49:31:20 molar ratio. The wavelength of peak light absorption for all emulsions was around 456 nm, and the half-peak dye absorption bandwidth was around 50 nm.

TABLE 1-3

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EY-01 | 4.10 | 0.13 | 31.5 | 3.7 |
| EY-02 | 2.20 | 0.12 | 18.3 | 3.9 |
| EY-03 | 1.30 | 0.10 | 13.0 | 3.7 |

TABLE 1-3-continued

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EY-04 | 0.52 | 0.12 | 4.3 | 3.7 |
| EY-05 | 0.57 | 0.07 | 8.1 | 1.3 |

Red Light Sensitive Emulsions

Silver iodobromide tabular grain emulsions EC-06, EC-07, EC-08, and EC-09 were provided having the significant grain characteristics set out in Table 1-4 below. Tabular grains accounted for greater than 70 percent of total grain projected area in all instances. Each of Emulsions EC-06 through EC-09 were optimally sulfur and gold sensitized. In addition, these emulsions were optimally spectrally sensitized with SD-09 and SD-10 in a 2:1 molar ratio. The wavelength of peak light absorption for all emulsions was around 628 nm, and the half-peak absorption bandwidth was around 44 nm.

TABLE 1-4

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EC-06 | 2.60 | 0.12 | 21.7 | 3.7 |
| EC-07 | 1.30 | 0.12 | 10.8 | 4.1 |
| EC-08 | 0.55 | 0.08 | 6.9 | 1.5 |
| EC-09 | 0.66 | 0.12 | 5.5 | 4.1 |

Green Light-sensitive Emulsions

Silver iodobromide tabular grain emulsions EM-05, EM-06, EM-07, and EM-08 were provided having the significant grain characteristics set out in Table 1-5 below. Tabular grains accounted for greater than 70 percent of total grain projected area in all instances. Each of Emulsions EM-05 through EM-08 were optimally sulfur and gold sensitized. In addition, emulsions EM-05 through EM-08 were optimally spectrally sensitized with SD-05 and SD-12 in a four and a half to one molar ratio of dye. The wavelength of peak light absorption for all emulsions was around 545 nm, and the half-peak dyed absorption bandwidth was around 48 nm for all emulsions.

TABLE 1-5

| Emulsion size and iodide content | | | | |
|---|---|---|---|---|
| Emulsion | Average grain ECD (μm) | Average grain thickness, (μm) | Average Aspect Ratio | Average Iodide Content (mol %) |
| EM-05 | 2.50 | 0.14 | 17.9 | 4.1 |
| EM-06 | 1.20 | 0.11 | 10.9 | 4.1 |
| EM-07 | 0.92 | 0.12 | 7.7 | 4.1 |
| EM-08 | 0.81 | 0.12 | 6.8 | 2.6 |

Blue Light Sensitive Emulsions

Silver iodobromide tabular grain emulsions EY-06, EY-07, EY-08, and EY-09 were provided having the significant grain characteristics set out in Table 1-6 below. Tabular grains accounted for greater than 70 percent of total grain projected area in all instances. Emulsion EY-06, a thick conventional grain was also provided. Each of Emulsions EY-06 through EY-09 were optimally sulfur and gold sensitized. In addition, these emulsions were optimally spectrally sensitized with SD-01 and SD-02 in a one to one molar ratio. The wavelength of peak light dye absorption for all emulsions was around 462 nm, and a second peak was present at around 442 nm. The half-peak dyed absorption bandwidth was around 45 mn for all emulsions.

TABLE 1-6

Emulsion size and iodide content

| Emulsion | Average grain ECD (μm) | Average grain thickness, (μm) | Average Aspect Ratio | Average Iodide Content (mol %) |
|---|---|---|---|---|
| EY-06 | 1.04 | Not applicable | Not applicable | 9.0 |
| EY-07 | 1.30 | 0.14 | 9.3 | 4.1 |
| EY-08 | 0.77 | 0.14 | 5.5 | 1.5 |
| EY-09 | 0.55 | 0.08 | 6.9 | 1.5 |

Red Light Sensitive Emulsions

Silver iodobromide tabular grain unsensitized emulsions EC-10, EC-11, EC-12, EC-13, and EC-14 were identical to the unsensitized EC-01, EC-02, EC-03, EC-04, and EC-05, respectively. Each of emulsions EC-10 through EC-14 were optimally sulfur and gold sensitized. In addition, these emulsions were optimally spectrally sensitized with SD-05, SD-08, SD-07, SD-09, SD-10, and SD-11 in a 10:55:15:8:8:4 molar ratio. The wavelength of peak light absorption for all emulsions was around 567 nm, and the half-peak absorption bandwidth was around 70 nm.

Silver iodobromide tabular grain emulsions unsensitized EC-15, EC-16, EC-17, EC-18, and EC-19 were identical to the unsensitized EC-01, EC-02, EC-03, EC-04, and EC-05, respectively. Each of emulsions EC-15 through EC-19 were optimally sulfur and gold sensitized. In addition, these emulsions were optimally spectrally sensitized with SD-17, SD-18, and SD-11 in a 55:35:10 molar ratio. The wavelength of peak light absorption for all emulsions was around 578, with a second peak at 610 nm. The half-peak absorption bandwidth was over 59 nm.

Silver iodobromide tabular grain unsensitized emulsions EC-20, EC-21, EC-22, EC-23, and EC-24 were identical to the unsensitized EC-01, EC-02, EC-03, EC-04, and EC-05, respectively. Each of emulsions EC-20 through EC-24 were optimally sulfur and gold sensitized. In addition, these emulsions were optimally spectrally sensitized with SD-10 and SD-19 in a 9:1 molar ratio. The wavelength of peak light absorption for all emulsions was around 653 nm, and the half-peak absorption bandwidth was around 36 nm.

Green Light-sensitive Emulsions

Silver iodobromide tabular grain emulsions EM-09, EM-10, EM-11, and EM-12 were provided having the significant grain characteristics set out in Table 1-7 below. Tabular grains accounted for greater than 70 percent of total grain projected area in all instances. Each of Emulsions EM-09 through EM-12 were optimally sulfur and gold sensitized. In addition, the emulsions were optimally spectrally sensitized with SD-13, SD-05, SD-06, and SD-07 in a 15:50:20:15 molar ratio. The wavelength of peak light absorption for all emulsions was around 558 nm, and the half-peak absorption bandwidth was around 73 nm. Substantial absorption was provided at 520, 550, and 560 nm.

TABLE 1-7

Emulsion size and iodide content

| Emulsion | Average grain ECD (μm) | Average grain thickness, (μm) | Average Aspect Ratio | Average Iodide Content (mol %) |
|---|---|---|---|---|
| EM-09 | 2.40 | 0.12 | 20.0 | 3.6 |
| EM-10 | 1.30 | 0.10 | 13.0 | 3.7 |
| EM-11 | 0.90 | 0.12 | 7.5 | 3.7 |
| EM-11 | 0.57 | 0.07 | 8.1 | 1.3 |

Silver iodobromide tabular grain emulsions EM-13, EM-14, EM-15, and EM-16 were provided having the significant grain characteristics set out in Table 1-8 below. Tabular grains accounted for greater than 70 percent of total grain projected area in all instances. Each of emulsions EM-13 through EM-16 were optimally sulfur and gold sensitized. In addition, the emulsions EM-13 and EM-14 were optimally spectrally sensitized with SD-14, SD-05, and SD-15 in a 23.6:38.2:38.2 molar ratio. Emulsions EM-15 and EM-16 were optimally spectrally sensitized with SD-14, SD-05, and SD-16 in a 23.6:38.2:38.2 molar ratio. The wavelength of peak light absorption for all emulsions was around 542 nm, and the half-peak absorption bandwidth was around 25 nm.

TABLE 1-8

Emulsion size and iodide content

| Emulsion | Average grain ECD (μm) | Average grain thickness, (μm) | Average Aspect Ratio | Average Iodide Content (mol %) |
|---|---|---|---|---|
| EM-13 | 1.40 | 0.30 | 4.7 | 3.5 |
| EM-14 | 0.70 | 0.34 | 2.1 | 3.5 |
| EM-15 | 0.90 | 0.12 | 7.5 | 3.7 |
| EM-16 | 0.57 | 0.07 | 8.1 | 1.3 |

Blue Light Sensitive Emulsions

Silver iodobromide tabular grain emulsions EY-10, EY-11, EY-12, and EY-13 were provided having the significant grain characteristics set out in Table 1-9 below. Tabular grains accounted for greater than 70 percent of total grain projected area in all instances. Each of Emulsions EY-10 through EY-13 were optimally sulfur and gold sensitized. In addition, these emulsions were optimally spectrally sensitized with SD-01 and SD-02 in a 1:1 molar ratio. The wavelength of peak light dye absorption for all emulsions was around 462 nm, and a second peak was present at around 442 nm. The half-peak dyed absorption bandwidth was around 45 nm for all emulsions.

TABLE 1-9

Emulsion size and iodide content

| Emulsion | Average grain ECD (μm) | Average grain thickness, (μm) | Average Aspect Ratio | Average Iodide Content (mol %) |
|---|---|---|---|---|
| EY-10 | 2.2 | 0.12 | 18.3 | 3.9 |
| EY-11 | 1.30 | 0.10 | 13.0 | 3.7 |
| EY-12 | 0.52 | 0.12 | 4.3 | 3.7 |
| EY-13 | 0.57 | 0.07 | 8.1 | 1.3 |

COLOR NEGATIVE ELEMENT PROPERTIES

All coating coverages are reported in parenthesis in terms of g/m2, except as otherwise indicated. Silver halide coating coverages are reported in terms of silver.

The slower, mid-speed, and faster emulsion layers within each of the blue (BU), green (GU), and red (RU) recording layer units are indicated by the prefix S, M, and F, respectively.

Sample 101 (Invention)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

| | |
|---|---|
| Layer 1: AHU | |
| Black colloidal silver sol | (0.151) |
| UV-1 | (0.075) |
| UV-2 | (0.108) |
| Oxidized developer scavenger S-1 | (0.161) |
| Compensatory printing density cyan dye CD-1 | (0.016) |
| Compensatory printing density magenta dye MD-1 | (0.038) |
| Compensatory printing density yellow dye MM-2 | (0.178) |
| HBS-1 | (0.105) |
| HBS-2 | (0.341) |
| HBS-4 | (0.038) |
| HBS-7 | (0.011) |
| Disodium salt of 3,5-disulfocatechol | (0.228) |
| Gelatin | (2.044) |
| Layer 2: SRU | |
| This layer was comprised of a blend of a lower, medium, and higher (lower, medium, and higher grain ECD) sensitivity, red-sensitized tabular silver iodobromide emulsions. | |
| Emulsion EC-03, silver content | (0.430) |
| Emulsion EC-04, silver content | (0.215) |
| Emulsion EC-05, silver content | (0.269) |
| Bleach accelerator releasing coupler B-1 | (0.057) |
| Oxidized developer scavenger S-3 | (0.183) |
| Development inhibitor releasing coupler D-7 | (0.013) |
| Cyan dye forming coupler C-1 | (0.344) |
| Cyan dye forming coupler C-2 | (0.038) |
| HBS-2 | (0.026) |
| HBS-5 | (0.118) |
| HBS-6 | (0.120) |
| TAI | (0.615) |
| Gelatin | (1.679) |
| Layer 3: MRU | |
| Emulsion EC-02, silver content | (1.076) |
| Bleach accelerator releasing coupler B-1 | (0.022) |
| Development inhibitor releasing coupler D-1 | (0.011) |
| Development inhibitor releasing coupler D-7 | (0.013) |
| Oxidized developer scavenger S-3 | (0.183) |
| Cyan dye forming coupler C-1 | (0.086) |
| Cyan dye forming coupler C-2 | (0.086) |
| HBS-1 | (0.044) |
| HBS-2 | (0.026) |
| HBS-5 | (0.097) |
| HBS-6 | (0.074) |
| TAI | (0.021) |
| Gelatin | (1.291) |
| Layer 4: FRU | |
| Emulsion EC-01, silver content | (1.291) |
| Development inhibitor releasing coupler D-1 | (0.011) |
| Development inhibitor releasing coupler D-7 | (0.011) |
| Oxidized developer scavenger S-1 | (0.014) |
| Cyan dye forming coupler C-1 | (0.065) |
| Cyan dye forming coupler C-2 | (0.075) |
| HBS-1 | (0.044) |
| HBS-2 | (0.022) |
| HBS-4 | (0.021) |
| HBS-5 | (0.161) |
| TAI | (0.021) |
| Gelatin | (1.076) |

-continued

| | |
|---|---|
| Layer 5: Interlayer | |
| Oxidized developer scavenger S-1 | (0.086) |
| HBS-4 | (0.129) |
| Gelatin | (0.538) |
| Layer 6: SGU | |
| This layer was comprised of a blend of a lower and higher (lower and higher grain ECD) sensitivity, green-sensitized tabular silver iodobromide emulsions. | |
| Emulsion EM-03, silver content | (0.323) |
| Emulsion EM-04, silver content | (0.215) |
| Bleach accelerator releasing coupler B-1 | (0.012) |
| Development inhibitor releasing coupler D-7 | (0.011) |
| Oxidized developer scavenger S-3 | (0.183) |
| Magenta dye forming coupler M-1 | (0.301) |
| Stabilizer ST-1 | (0.060) |
| HBS-1 | (0.241) |
| HBS-2 | (0.022) |
| HBS-6 | (0.061) |
| TAI | (0.004) |
| Gelatin | (1.108) |
| Layer 7: MGU | |
| Emulsion EM-02, silver content | (0.968) |
| Bleach accelerator releasing coupler B-1 | (0.005) |
| Development inhibitor releasing coupler D-1 | (0.011) |
| Development inhibitor releasing coupler D-7 | (0.011) |
| Oxidized developer scavenger S-1 | (0.011) |
| Oxidized developer scavenger S-3 | (0.183) |
| Magenta dye forming coupler M-1 | (0.113) |
| Stabilizer ST-1 | (0.023) |
| HBS-1 | (0.133) |
| HBS-2 | (0.022) |
| HBS-4 | (0.016) |
| HBS-6 | (0.053) |
| TAI | (0.016) |
| Gelatin | (1.399) |
| Layer 8: FGU | |
| Emulsion EM-01, silver content | (0.968) |
| Development inhibitor releasing coupler D-1 | (0.009) |
| Development inhibitor releasing coupler D-7 | (0.011) |
| Oxidized developer scavenger S-1 | (0.011) |
| Magenta dye forming coupler M-1 | (0.097) |
| Stabilizer ST-1 | (0.019) |
| HBS-1 | (0.112) |
| HBS-2 | (0.022) |
| HBS-4 | (0.016) |
| TAI | (0.009) |
| Gelatin | (1.399) |
| Layer 9: Yellow Filter Layer | |
| Yellow filter dye YD-1 | (0.032) |
| Oxidized developer scavenger S-1 | (0.086) |
| HBS-4 | (0.129) |
| Gelatin | (0.646) |
| Layer 10: SBU | |
| This layer was comprised of a blend of a lower, lower-medium, medium, and higher (lower, lower-medium, medium, and higher grain ECD) sensitivity, blue-sensitized tabular silver iodobromide emulsions. | |
| Emulsion EY-02, silver content | (0.323) |
| Emulsion EY-03, silver content | (0.247) |
| Emulsion EY-04, silver content | (0.215) |
| Emulsion EY-05, silver content | (0.269) |
| Bleach accelerator releasing coupler B-1 | (0.003) |
| Development inhibitor releasing coupler D-7 | (0.011) |
| Oxidized developer scavenger S-3 | (0.183) |
| Yellow dye forming coupler Y-1 | (0.710) |
| HBS-2 | (0.022) |
| HBS-5 | (0.151) |
| HBS-6 | (0.050) |
| TAI | (0.016) |
| Gelatin | (1.872) |

-continued

| | |
|---|---|
| Layer 11: FBU | |
| Emulsion EY-01, silver content | (0.699) |
| Bleach accelerator releasing coupler B-1 | (0.005) |
| Development inhibitor releasing coupler D-7 | (0.013) |
| Yellow dye forming coupler Y-1 | (0.140) |
| HBS-2 | (0.026) |
| HBS-5 | (0.118) |
| HBS-6 | (0.007) |
| TAI | (0.011) |
| Gelatin | (1.291) |
| Layer 12: Protective Overcoat Layer | |
| Polymethylmethacrylate matte beads | (0.005) |
| Soluble polymethylmethacrylate matte beads | (0.054) |
| Unsensitized silver bromide Lippmann emulsion | (0.215) |
| Dye UV-1 | (0.108) |
| Dye UV-2 | (0.216) |
| Silicone lubricant | (0.040) |
| HBS-1 | (0.151) |
| HBS-7 | (0.108) |
| Gelatin | (1.237) |

This film was hardened at the time of coating with 1.75% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 102 (Comparative control)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

| | |
|---|---|
| Layer 1: AHU | |
| Black colloidal silver sol | (0.107) |
| UV-1 | (0.075) |
| UV-2 | (0.075) |
| Oxidized developer scavenger S-1 | (0.161) |
| Compensatory printing density cyan dye CD-1 | (0.034) |
| Compensatory printing density magenta dye MD-1 | (0.013) |
| Compensatory printing density yellow dye MM-2 | (0.095) |
| HBS-1 | (0.105) |
| HBS-2 | (0.433) |
| HBS-4 | (0.013) |
| Disodium salt of 3,5-disulfocatechol | (0.215) |
| Gelatin | (2.152) |
| Layer 2: SRU<br>This layer was comprised of a blend of a lower and higher (lower and higher grain ECD) sensitivity, red-sensitized tabular silver iodobromide emulsions respectively. | |
| Emulsion EC-09, silver content | (0.355) |
| Emulsion EC-08, silver content | (0.328) |
| Bleach accelerator releasing coupler B-1 | (0.075) |
| Development inhibitor releasing coupler D-5 | (0.015) |
| Cyan dye forming coupler C-1 | (0.359) |
| HBS-2 | (0.405) |
| HBS-6 | (0.098) |
| TAI | (0.011) |
| Gelatin | (1.668) |
| Layer 3: MRU | |
| Emulsion EC-07, silver content | (1.162) |
| Bleach accelerator releasing coupler B-1 | (0.005) |
| Development inhibitor releasing coupler D-5 | (0.016) |
| Cyan dye forming magenta colored coupler CM-1 | (0.059) |

-continued

| | |
|---|---|
| Cyan dye forming coupler C-1 | (0.207) |
| HBS-2 | (0.253) |
| HBS-6 | (0.007) |
| TAI | (0.019) |
| Gelatin | (1.291) |
| Layer 4: FRU | |
| Emulsion EC-06, silver content | (1.060) |
| Bleach accelerator releasing coupler B-1 | (0.005) |
| Development inhibitor releasing coupler D-5 | (0.027) |
| Development inhibitor releasing coupler D-1 | (0.048) |
| Cyan dye forming magenta colored coupler CM-1 | (0.022) |
| Cyan dye forming coupler C-1 | (0.323) |
| HBS-1 | (0.194) |
| HBS-2 | (0.274) |
| HBS-6 | (0.007) |
| TAI | (0.010) |
| Gelatin | (1.291) |
| Layer 5: Interlayer | |
| Oxidized developer scavenger S-1 | (0.086) |
| HBS-4 | (0.129) |
| Gelatin | (0.538) |
| Layer 6: SGU<br>This layer was comprised of a blend of a lower and higher (lower and higher grain ECD) sensitivity, green-sensitized tabular silver iodobromide emulsions respectively. | |
| Emulsion EM-08, silver content | (0.251) |
| Emulsion EM-07, silver content | (0.110) |
| Magenta dye forming yellow colored coupler MM-1 | (0.054) |
| Magenta dye forming coupler M-1 | (0.339) |
| Stabilizer ST-1 | (0.034) |
| HBS-1 | (0.413) |
| TAI | (0.006) |
| Gelatin | (1.184) |
| Layer 7: MGU<br>This layer was comprised of a blend of a lower and higher (lower and higher grain ECD) sensitivity, green-sensitized tabular silver iodobromide emulsions. | |
| Emulsion EM-07, silver content | (0.091) |
| Emulsion EM-06, silver content | (1.334) |
| Development inhibitor releasing coupler D-6 | (0.032) |
| Magenta dye forming yellow colored coupler MM-1 | (0.118) |
| Magenta dye forming coupler M-1 | (0.087) |
| Oxidized developer scavenger S-2 | (0.018) |
| HBS-1 | (0.315) |
| HBS-2 | (0.032) |
| Stabilizer ST-1 | (0.009) |
| TAI | (0.023) |
| Gelatin | (1.668) |
| Layer 8: FGU | |
| Emulsion EM-05, silver content | (0.909) |
| Development inhibitor releasing coupler D-3 | (0.003) |
| Development inhibitor releasing coupler D-7 | (0.032) |
| Oxidized developer scavenger S-2 | (0.023) |
| Magenta dye forming yellow colored coupler MM-1 | (0.054) |
| Magenta dye forming coupler M-1 | (0.113) |
| HBS-1 | (0.216) |
| HBS-2 | (0.064) |
| Stabilizer ST-1 | (0.011) |
| TAI | (0.011) |
| Gelatin | (1.405) |
| Layer 9: Yellow Filter Layer | |
| Yellow filter dye YD-1 | (0.054) |
| Oxidized developer scavenger S-1 | (0.086) |
| HBS-4 | (0.129) |
| Gelatin | (0.646) |
| Layer 10: SBU<br>This layer was comprised of a blend of a lower, medium, and higher (lower, medium, and higher grain ECD) sensitivity, blue-sensitized tabular silver iodobromide emulsions. | |

-continued

| | |
|---|---|
| Emulsion EY-09, silver content | (0.140) |
| Emulsion EY-08, silver content | (0.247) |
| Emulsion EY-07, silver content | (0.398) |
| Development inhibitor releasing coupler D-5 | (0.027) |
| Development inhibitor releasing coupler D-4 | (0.054) |
| Yellow dye forming coupler Y-1 | (1.022) |
| Cyan dye forming coupler C-1 | (0.027) |
| Bleach accelerator releasing coupler B-1 | (0.011) |
| HBS-1 | (0.592) |
| HBS-2 | (0.108) |
| HBS-6 | (0.014) |
| TAI | (0.014) |
| Gelatin | (2.119) |
| Layer 11: FBU | |
| This layer was comprised of a blue-sensitized tabular silver iodobromide emulsion containing 9.0 M % iodide, based on silver. | |
| Emulsion EY-06, silver content | (0.699) |
| Unsensitized silver bromide Lippmann emulsion | (0.054) |
| Yellow dye forming coupler Y-1 | (0.473) |
| Development inhibitor releasing coupler D-4 | (0.086) |
| Bleach accelerator releasing coupler B-1 | (0.005) |
| HBS-1 | (0.280) |
| HBS-6 | (0.007) |
| TAI | (0.012) |
| Gelatin | (1.183) |
| Layer 12: Ultraviolet Filter Layer | |
| Dye UV-1 | (0.108) |
| Dye UV-2 | (0.108) |
| Unsensitized silver bromide Lippmann emulsion | (0.215) |
| HBS-1 | (0.151) |
| Gelatin | (0.699) |
| Layer 13: Protective Overcoat Layer | |
| Polymethylmethacrylate matte beads | (0.005) |
| Soluble polymethylmethacrylate matte beads | (0.108) |
| Silicone lubricant | (0.039) |
| Gelatin | (0.882) |

This film was hardened at the time of coating with 1.80% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 103 (Invention) color photographic recording material for color negative development was prepared exactly as above in Sample 101, except where noted below.

| | |
|---|---|
| Layer 10: SBU Changes | |
| Emulsion EY-05, silver content | (0.000) |
| Emulsion EY-04, silver content | (0.000) |
| Emulsion EY-03, silver content | (0.000) |
| Emulsion EY-02, silver content | (0.000) |
| Emulsion EY-13, silver content | (0.269) |
| Emulsion EY-12, silver content | (0.215) |
| Emulsion EY-11, silver content | (0.247) |
| Emulsion EY-10, silver content | (0.323) |
| Layer 11: FBU Changes | |
| Emulsion EY-01 | (0.000) |
| Emulsion EY-06 | (0.699) |

Sample 104 (Invention) color photographic recording material for color negative development was prepared exactly as above in Sample 101, except where noted below.

| | |
|---|---|
| Layer 2: SRU Changes | |
| Emulsion EC-63, silver content | (0.000) |
| Emulsion EC-04, silver content | (0.000) |
| Emulsion EC-05, silver content | (0.000) |
| Emulsion EC-12, silver content | (0.430) |
| Emulsion EC-13, silver content | (0.215) |
| Emulsion EC-14, silver content | (0.269) |
| Layer 3: MRU Changes | |
| Emulsion EC-02, silver content | (0.000) |
| Emulsion EC-11, silver content | (1.076) |
| Layer 4: FRU Changes | |
| Emulsion EC-01, silver content | (0.000) |
| Emulsion EC-10, silver content | (01.291) |
| Layer 6: SGU Changes | |
| Emulsion EM-03, silver content | (0.000) |
| Emulsion EM-04, silver content | (0.000) |
| Emulsion EM-11, silver content | (0.323) |
| Emulsion EM-12, silver content | (0.215) |
| Layer 7: MGU Changes | |
| Emulsion EM-02, silver content | (0.000) |
| Emulsion EM-10, silver content | (0.968) |
| Layer 8: FGU Changes | |
| Emulsion EM-01, silver content | (0.000) |
| Emulsion EM-09, silver content | (0.968) |

Sample 105 (Comparative control) color photographic recording material for color negative development was prepared exactly as above in Sample 103, except where noted below.

| | |
|---|---|
| Layer 2: SRU Changes | |
| Emulsion EC-03, silver content | (0.000) |
| Emulsion EC-04, silver content | (0.000) |
| Emulsion EC-05, silver content | (0.000) |
| Emulsion EC-17, silver content | (0.430) |
| Emulsion EC-18, silver content | (0.215) |
| Emulsion EC-19, silver content | (0.269) |
| Layer 3: MRU Changes | |
| Emulsion EC-02, silver content | (0.000) |
| Emulsion EC-16, silver content | (1.076) |
| Layer 4: FRU Changes | |
| Emulsion EC-01, silver content | (0.000) |
| Emulsion EC-15, silver content | (1.291) |
| Layer 6: SGU Changes | |
| Emulsion EM-03, silver content | (0.000) |
| Emulsion EM-04, silver content | (0.000) |
| Emulsion EM-15, silver content | (0.323) |
| Emulsion EM-16, silver content | (0.215) |
| Layer 7: MGU Changes | |
| Emulsion EM-02, silver content | (0.000) |
| Emulsion EM-14, silver content | (0.968) |
| Layer 8: FGU Changes | |
| Emulsion EM-01, silver content | (0.000) |
| Emulsion EM-13, silver content | (0.968) |

Sample 106 (Comparative control) color photographic recording-material for color negative development was prepared exactly as above in Sample 101, except where noted below.

| | |
|---|---|
| Layer 6: SGU Changes | |
| Emulsion EM-03, silver content | (0.000) |
| Emulsion EM-04, silver content | (0.000) |
| Emulsion EM-15, silver content | (0.323) |
| Emulsion EM-16, silver content | (0.215) |
| Layer 7: MGU Changes | |
| Emulsion EM-02, silver content | (0.000) |
| Emulsion EM-14, silver content | (0.968) |
| Layer 8: FGU Changes | |
| Emulsion EM-01, silver content | (0.000) |
| Emulsion EM-13, silver content | (0.968) |

Sample 107 (Comparative control) color photographic recording material for color negative development was prepared exactly as above in Sample 101, except where noted below.

| | |
|---|---|
| Layer 2: SRU Changes | |
| Emulsion EC-03, silver content | (0.000) |
| Emulsion EC-04, silver content | (0.000) |
| Emulsion EC-05, silver content | (0.000) |
| Emulsion EC-22, silver content | (0.430) |
| Emulsion EC-23, silver content | (0.215) |
| Emulsion EC-24, silver content | (0.269) |
| Layer 3: MRU Changes | |
| Emulsion EC-02, silver content | (0.000) |
| Emulsion EC-21, silver content | (1.076) |
| Layer 4: FRU Changes | |
| Emulsion EC-01, silver content | (0.000) |
| Emulsion EC-20, silver content | (1.291) |

The sensitivities over the visible spectrum of the individual color units of the photographic recording materials, Samples 101–107, were determined in 5-nm increments using nearly monochromatic light of carefully calibrated output from 360 to 715 nm. Photographic recording materials Samples 101–107 were individually exposed for 1/100 of a second to white light from a tungsten light source of 3000K color temperature that was filtered by a Daylight Va filter to 5500K and by a monochromator with a 4-nm bandpass resolution through a graduated 0–4.0 density step tablet with 0.3-density step increments to determine their speed. The samples were then processed using the KODAK FLEXICOLOR™ C-41 Process, as described by *The British Journal of Photography Annual* of 1988, pp. 196–198. Another description of the use of the FLEXICOLOR™ process is provided by *Using Kodak Flexicolor Chemicals*, Kodak Publication No. Z-131, Eastman Kodak Company, Rochester, N.Y.

Following processing and drying, Samples 101–107 were subjected to Status M densitometry and their sensitometric performance over the visible spectrum was characterized. The exposure required to produce a density increase of 0.20 above Dmin was determined for the color recording units at each 5-nm increment exposed. The exposure distribution for each of the red, green and blue responsivities was normalized by its maximum sensitivity to convert each of the 5-nm sample sensitivities to relative sensitivities for plotting as a function of wavelength, as in FIGS. 1 and 2. A second set of speeds was generated by taking the Status M densitometry and transforming it to analytical densities using a 3×3 matrix treatment appropriate for the image dye set according to methods disclosed in the art cited earlier. The exposure required to produce a analytical density increase of 0.20 above Dmin was determined for the color recording units at each 5-nm increment exposed. The exposure distribution for each of the red, green and blue responsivities was normalized by its maximum sensitivity to convert each of the 5-nm sample sensitivities to relative sensitivities for plotting, as also in FIGS. 1 and 2, and FIGS. 3 to 9 as well.

The spectral sensitivity response of the photographic recording materials was also used to determine the relative calorimetric accuracy of color negative materials Samples 101–107 in recording a particular diverse set of 200 different color patches according to the method disclosed by Giorgianni et al, in U.S. Pat. No. 5,582,961. The computed color error variance is included in Table 3-1. This error value relates to the color difference between the CIELAB space coordinates of the specified set of test colors and the space coordinates resulting from a specific transformation of the test colors as rendered by the film. In particular, the test patch input spectral reflectance values for a given light source are convolved with the sample photographic materials' spectral sensitivity response to estimate calorimetric recording capability. It should be noted that the computed color error is sensitive to the responses of all three input color records, and an improved response by one record may not overcome the responses of one or two other limiting color records. A color error difference of at least 1 unit corresponds to a significant difference in color recording accuracy. The points divergence of the comparative controls from the requirements of the invention are highlighted in bold.

When red emulsion unit maximum sensitivity greater than 620 nm was employed, as in conventional optical print color negative films containing colored masking couplers (e.g. Sample 102, comparative control), a substantial color error of 10 or higher resulted, indicating quite significant metameric color failure at the time of capture of the scene light exposures. The use of more hypsochromic red spectral sensitivities with peak response below 620 nm of and by itself was insufficient to produce calorimetrically accurate recording. Sample 105, which is representative of color matching function spectral sensitivity films of the art, provided the required wavelengths of maximum sensitivity, and appreciable overlap between the green and red recording unit's spectral sensitivity. But Sample 105 and 106 both provided green unit breadth of sensitivity under 65 nm and short green sensitivity at 520 nm well below 60%, and consequently inadequate color accuracy levels resulted.

The use of more hypsochromic, broad green spectral sensitivities with peak response below 565 nm of and by itself was insufficient to produce calorimetrically accurate recording as well. The combination of maximum green sensitivity of between about 520 and 565 nm, overall half-maximum relative sensitivity bandwidth of greater than 65 nm, and relative sensitivity at 520 nm of at least 60% of maximum with a red emulsion unit maximum sensitivity of greater than 620 nm in Sample 107 likewise produced a high color error indicating poor color accuracy. Only when all of the requirements of the invention are met simultaneously does a marked reduction in color error variance occur which is indicative of much higher color recording fidelity (e.g. inventive Samples 101, 103, and 104). These Samples representing preferred embodiments of the invention are much better suited for providing image records of the incident scene light for electronic image processing into viewable form which have significantly reduced metameric color failure or fewer artifacts due to illuminant metamerism.

TABLE 2-1

| Sample | RU emulsion sensitivity λmax (nm) | GU emulsion sensitivity λmax (nm) | BU emulsion sensitivity λmax (nm) | GU emulsion relative sensitivity half-peak bandwidth (nm) | GU emulsion relative sensitivity at 520 nm (%) | RU and GU equal relative emulsion sensitivity λmax (nm) | RU and GU equal relative emulsion sensitivity as fraction of maximum (%) | RU emulsion relative sensitivity at 560 nm (%) | Capture Color Error |
|---|---|---|---|---|---|---|---|---|---|
| | Multicolor recording material spectral sensitivity | | | | | | | | |
| 101 (Inv) | 596 | 540 | 457 | 73 | 72 | 572 | 53 | 29 | 2.7 |
| 102 (Comp) | 625 | 546 | 472 | 49 | 45 | 583 | 18 | 3 | 10.0 |
| 103 (Inv) | 592 | 541 | 471 | 72 | 73 | 573 | 51 | 27 | 3.2 |
| 104 (Inv) | 593 | 564 | 453 | 80 | 69 | 577 | 57 | 17 | 2.2 |
| 105 (Comp) | 581 | 546 | 470 | 26 | 43 | 555 | 30 | 47 | 7.5 |
| 106 (Comp) | 592 | 546 | 458 | 27 | 42 | 555 | 45 | 75 | 12.0 |
| 107 (Comp) | 653 | 541 | 422 | 70 | 69 | 582 | 22 | 4 | 14.5 |

The invention has been described in detail with particular reference to certain preferred embodiments thereof, but it will be understood that variations and modifications can be effected within the spirit and scope of the invention.

What is claimed is:

1. A color photographic element capable of producing dye images suitable for digital scanning comprised of a support and, coated on the support, a plurality of hydrophilic colloid layers including a blue recording emulsion lay unit capable of forming a dye a geen recording emulsion layer unit capable of fonning a dye image of a second hue, and a red recording emulsion layer unit capable of forming a dye image of a third hue and comprising an emulsion layer, which contains a silver halide emulsion spectrally sensitized with at least four sensitizing dyes, wherein, (1) the wavelength of maximum sensitivity of the red recording emulsion layer unit is between about 580 and 605 nm, (2) the wavelength of maximum sensitivity of the green recording emulsion layer unit is between about 520 and 565 nm, (3) the relative sensitivity of the green recording emulsion layer unit at 50% of the maximum sensitivity exhibits an overall breadth of at least about 65 nm, and (4) the relative sensitivity of the green recording emulsion layer unit at 520 nm is at least 60% of the maximum, with the proviso that magenta colored filter materials are absent from the red recording emulsion layer unit.

2. A color photographic element capable of producing dye images suitable for digital scanning according to claim 1 wherein the relative sensitivities of the green recording emulsion layer unit and of the red recording emulsion layer unit overlap between about 550 and 600 nm and the overlap is at least about 35% of the maximum relative sensitivity.

3. A color photographic element capable of producing dye images suitable for digital scanning according to claim 1 wherein the relative sensitivity of the red recording emulsion layer unit at 560 nm is at least about 25% of the maximum sensitivity.

4. A color photographic element capable of producing dye images suitable for digital scanning according to claim 1 wherein the wavelength of maximum sensitivity of the blue recording emulsion layer unit is between about 430 nm and 470 nm.

5. A color photographic element capable of producing dye images suitable for digital scanning according to claim 1 wherein the recording layer units are substantially free of colored masking couplers.

6. A color photographic element capable of producing dye images suitable for digital scanning according to claim 5 wherein the photographic recording material is a color negative film.

7. A color photographic element capable of producing dye images suitable for digital scanning according to claim 1 wherein an interlayer is interposed between the green and red recording layer units with the proviso that the interlayer is substantially free of magenta colored filter materials.

8. A color photographic element capable of producing dye images suitable for digital scanning according to claim 7 wherein magenta colored masking couplers are absent from the red recording emulsion layer unit.

9. A color photographic element capable of producing dye images suitable for digital scanning according to claim 8 wherein the wavelength of maximum sensitivity of the blue recording emulsion layer unit is between about 430 nm and 470 nm.

10. A color photographic element capable of producing dye images suitable for digital scanning according to claim 9 wherein the element is a color negative recording material.

11. A color negative film capable of producing dye images suitable for digital scanning according to claim 10 wherein each blue recording layer unit contains a yellow dye-forming coupler, each green recording layer unit contains a magenta dye-forming coupler, and each red recording layer unit contains a cyan dye-forming coupler.

* * * * *